US009517476B2

(12) United States Patent
Ooyama et al.

(10) Patent No.: US 9,517,476 B2
(45) Date of Patent: Dec. 13, 2016

(54) CENTRIFUGE WITH ACCELERATION AND DECELERATION TIME DISPLAY

(75) Inventors: Hisanobu Ooyama, Ibaraki (JP); Hiroyuki Takahashi, Ibaraki (JP); Shoji Kusumoto, Ibaraki (JP); Shinichi Haruki, Ibaraki (JP); Yuki Shimizu, Ibaraki (JP)

(73) Assignee: HITACHI KOKI CO., LTD., Tokyo (JP)

( * ) Notice: Subject to any disclaimer, the term of this patent is extended or adjusted under 35 U.S.C. 154(b) by 1020 days.

(21) Appl. No.: 13/126,762

(22) PCT Filed: Oct. 30, 2009

(86) PCT No.: PCT/JP2009/069011

§ 371 (c)(1),
(2), (4) Date: Apr. 28, 2011

(87) PCT Pub. No.: WO2010/050624

PCT Pub. Date: May 6, 2010

(65) Prior Publication Data

US 2011/0207590 A1 Aug. 25, 2011

(30) Foreign Application Priority Data

Oct. 31, 2008 (JP) ..... P2008-281250
Nov. 5, 2008 (JP) ..... P2008-284861
Sep. 1, 2009 (JP) ..... P2009-202108

(51) Int. Cl.
*B04B 13/00* (2006.01)
*B04B 9/10* (2006.01)
*B04B 15/08* (2006.01)

(52) U.S. Cl.
CPC ..... *B04B 9/10* (2013.01); *B04B 13/00* (2013.01); *B04B 15/08* (2013.01)

(58) Field of Classification Search
CPC ..... B04B 13/00; B04B 2013/00; B04B 9/10; B04B 15/08
(Continued)

(56) References Cited

U.S. PATENT DOCUMENTS 3,246,688 A * 4/1966 Colhurn ..... 165/288
3,332,608 A * 7/1967 Landfors ..... 417/153
(Continued)

FOREIGN PATENT DOCUMENTS

EP 0344453 A2 12/1989
JP 06-079199 A 3/1994
(Continued)

OTHER PUBLICATIONS

International Search Report Feb. 16, 2010.
(Continued)

*Primary Examiner* — Charles Cooley
*Assistant Examiner* — Marc C Howell
(74) *Attorney, Agent, or Firm* — Kenealy Vaidya LLP

(57) ABSTRACT

According to an aspect of the present invention, there is provided a centrifuge including: a driving unit which rotates a rotor on which a sample is held; an input/output unit which displays information thereon and receives an input from a user therethrough; and a control unit which controls a rotation speed of the rotor to an input set rotation speed; wherein, when the rotor is rotating, the input/output unit displays first time information corresponding to a time when the rotor has been accelerated to the set rotation speed.

21 Claims, 14 Drawing Sheets

(58) Field of Classification Search
USPC ..... 494/10, 11
See application file for complete search history.

(56) References Cited

U.S. PATENT DOCUMENTS

| | | | | |
|---|---|---|---|---|
| 4,244,513 | A | 1/1981 | Fayer et al. | |
| 5,171,206 | A * | 12/1992 | Marque | 494/37 |
| 5,287,265 | A * | 2/1994 | Hall et al. | 700/83 |
| 5,382,218 | A * | 1/1995 | Uchida | 494/10 |
| 6,679,821 | B1 * | 1/2004 | Numata et al. | 494/10 |
| 2003/0232712 | A1 * | 12/2003 | Dolecek et al. | 494/37 |
| 2005/0107235 | A1 | 5/2005 | Tetsu et al. | |
| 2008/0251436 | A1 | 10/2008 | Tetsu et al. | |

FOREIGN PATENT DOCUMENTS

| | | | |
|---|---|---|---|
| JP | 2002-346367 | A | 12/2002 |
| JP | 2005-118689 | A | 5/2005 |
| JP | 2006-255659 | A | 9/2006 |
| JP | 2007-44586 | A | 2/2007 |
| JP | 2007-198392 | A | 8/2007 |
| JP | 2008-023477 | A1 | 2/2008 |

OTHER PUBLICATIONS

Japanese Office Action for the related Japanese Patent Application No. 2009-202108 dated Jul. 22, 2013.
The Japanese Office Action for the related Japanese Patent Application No. 2008-281250 dated Jun. 24, 2013.

* cited by examiner

CENTRIFUGE WITH ACCELERATION AND DECELERATION TIME DISPLAY

TECHNICAL FIELD

The present invention relates to a centrifuge.

BACKGROUND ART

A centrifuge has been widely used in the fields of medicine, pharmacy, genetic engineering, and the like. Generally, the centrifuge having a maximum rotation speed in the range of 10,000 to 30,000 rpm is operated in the state where a rotation chamber used for rotating a rotor has an atmospheric pressure. In this case, a temperature of a sample may increase due to an increase in heat generated by the friction between the rotor and air generated during the rotation of the rotor. For this reason, in many cases, the centrifuge is attached with a cooling device such as a cooler using a coolant or a Peltier element. In this type of centrifuge, a user sets operation conditions such as a rotation speed, an operation time (separation time), and a holding temperature (set temperature) through a panel operation unit in accordance with the sample (specimen) to be separated.

Subsequently, the rotor having the sample inserted thereto is set in the rotation chamber, and a door is closed. When a start switch of the operation unit is pushed, the rotation of the rotor starts. When the rotor is accelerated up to a set rotation speed, the rotor uniformly rotates at the set rotation speed. When the rotor continuously rotates at the uniform set rotation speed and the set operation time is elapsed, the rotation of the rotor is decelerated, and the rotor stops. Subsequently, the user opens the door to extract the rotor, and extracts the separated sample from the rotor.

In such a series of centrifugal separation operations, it is not practical that the user continuously waits before the centrifuge to monitor the operation state from a time when the rotation of the rotor starts until the rotation of the rotor stops. This is because several minutes, several hours, or several tens of hours may be taken for the centrifugal separation operation. Accordingly, in many cases, the user pushes the start switch of the centrifuge so as to accelerate the rotor up to the set rotation speed, checks if the rotor arrives at the uniform set rotation speed, and then leaves from the centrifuge, performs other operations, or starts to prepare the next centrifugal separation operation. This is because the rotor rotating at a uniform rotation speed without the acceleration or deceleration is reliably rotated in many cases.

When the operation of the centrifuge stops after the set operation time is elapsed, a stop buzzer or a stop melody beeps. However, it is possible to easily recognize the stop state of the centrifuge when the user is close to the centrifuge, but it is difficult to listen to the buzzer or melody when the user is away from the centrifuge. For this reason, the user leaves from the centrifuge after the rotor starts to be accelerated up to the uniform set rotation speed, and returns to the centrifuge after the set operation time is elapsed. The returning timing may be set based on the set operation time or may be set based on a time displayed on an indicator in the case where a remaining operation time is displayed on the indicator as in JP-H06-079199-A. In addition, in the case where the user returns to the centrifuge immediately before the operation time is elapsed, the rotor may be not in a stop state but in a rotation state. In this case, during a time when the rotor starts to be decelerated to stop, the user of the centrifuge waits before the centrifuge in many cases so as to immediately extract the sample.

In the centrifuge, a best suitable rotor is selected from plural types of rotors in accordance with the separation condition or the sample to be separated, and the centrifuge is operated in a changed operation condition. Since there are plural types of rotors such as a light and small rotor (having small inertia moment) and a heavy and large rotor (having large inertial moment), the acceleration time until the set rotation speed or the deceleration time from the set rotation speed until the stop is different in accordance with the rotor to be used. Of course, the acceleration time and the deceleration time are short in the case of the rotor having small inertia moment, and are long in the case of the rotor having large inertial moment. For example, the acceleration time and the deceleration time are 20 minutes or more in the case of a certain large-sized rotor.

Further, even in the case of using the same rotor, the acceleration time until the rotor is stabilized at the set rotation speed or the deceleration time until the rotor stops from the set rotation speed is different in accordance with a difference in the amount of the set sample. In the technology disclosed in JP-H06-079199-A, the remaining operation time (the operation time when the rotor rotates at the uniform rotation speed) of the centrifuge is displayed, but the time required for the deceleration is not displayed. Accordingly, the user of the centrifuge needs to estimate the acceleration time and the deceleration time from the past operation record. However, since many users do not accurately recognize the acceleration time or the deceleration time, the users unthinkingly wait before the centrifuge while uselessly spending time without having any idea about the time when the rotor is stabilized at the set rotation speed and stops upon stopping (decelerating) the rotation of the rotor.

In a high-speed centrifuge designed to rotate at, for example, 40,000 rpm or more, a rotor is rotated in the state where a rotation chamber is depressurized by a vacuum pump in order to prevent the overheating of the rotor due to the friction with air during a high-speed rotation. An oil rotation vacuum pump is used as the vacuum pump in many cases, and generally an oil diffusion vacuum pump is connected in serial thereto so as to serve as a vacuum pump assisting the oil rotation vacuum pump. In addition, in order to maintain the rotor at the set temperature, the rotation chamber is provided with a cooling device.

As a vacuum device manufactured by combining the oil rotation vacuum pump with the oil diffusion vacuum pump, for example, a technology is known in JP-2007-198392-A. The technology disclosed in JP-2007-198392-A is proposed as a manufacturing facility, and describes that a vacuum arrival time is reduced and energy is saved. However, in the centrifuge, since the vacuum operation is repeated in the order of "depressurization→depressurization cancellation→depressurization" whenever performing a centrifugal separation operation, an oil temperature state of oil upon activating the oil diffusion vacuum pump is different for each operation. Accordingly, since the time until arriving at a predetermined vacuum degree is different for each operation, it is not easy for the user to estimate the time until arriving at the predetermined vacuum degree.

Meanwhile, in the centrifuge available in the market, a sign indicating a middle vacuum (133 Pa) or a high vacuum (13.3 Pa) or a value of a vacuum degree is directly displayed on a display unit. However, the centrifuge having a function of estimating and displaying the time arriving at the middle vacuum (133 Pa) or the high vacuum (13.3 Pa) is not introduced into the market yet. In addition, in the description of the present specification, a low vacuum indicates the range from the atmospheric pressure to 133 Pa, and a middle vacuum indicates the range from 133 Pa to 13.3 Pa, and a high vacuum indicates a pressure of 13.3 Pa or less.

In the known vacuum device manufactured by combining the oil rotation vacuum pump with the oil diffusion vacuum pump, the oil rotation vacuum pump is used as a main pump, the oil diffusion vacuum pump is used as an auxiliary pump, and the rotor is controlled so as not to rotate at a predetermined rotation speed (for example, a rotation speed of 5,000 rpm without an influence of overheat due to air resistance) or more when the predetermined vacuum degree is not obtained. For this reason, when starting the centrifugal separation operation, the user has no idea about the time until the depressurizing (vacuum) state where the rotor is able to rotate at the set rotation speed. Particularly, in a super centrifuge having a rotation speed of 40,000 rpm or more, since the rotation energy of the rotor is large, it is important to check whether the rotor normally rotates. For this reason, generally, the user leaves from the centrifuge after checking that the rotation of the rotor arrives at the maximum rpm. However, if there is no information on how long the depressurizing operation is performed until the predetermined vacuum degree or when the rotation of the rotor starts, the user waiting before the centrifuge feels trouble.

SUMMARY OF INVENTION

An object of the invention is to provide a centrifuge having means for notifying an acceleration time until a rotor is accelerated up to a set rotation speed and a deceleration time until the rotor is decelerated to stop.

Another object of the invention is to provide a centrifuge having means for notifying a time when a rotor is accelerated up to a set rotation speed and a time when the rotor is decelerated to stop.

The typical characteristics of the invention disclosed herein are as below.

According to a characteristic of the invention, there is provided a centrifuge rotating a rotor at an input set rotation speed, the centrifuge including: a driving unit which rotates the rotor holding a sample; a control unit which controls the rotation of the rotor; and an input/output unit which displays information thereon and receives an input from a user therethrough, wherein first time information until the rotation of the rotor is accelerated up to the set rotation speed from the current state is displayed on the input/output unit during the rotation of the rotor. Here, the first time information is a time until or when a rotation speed of the rotor arrives at the set rotation speed. Any one of the stabilization arrival time or the stabilization time may be displayed by using a change button or both of them may be simultaneously displayed.

According to another characteristic of the invention, the control unit stores in advance an acceleration time taken for each type of the rotor, and calculates the first time information by identifying the rotor attached to the driving unit and reading the acceleration time taken for the identified rotor. In addition, the control unit stores in advance a plurality of rotation acceleration inclination patterns of the rotor, and calculates the first time information by selecting the corresponding rotation acceleration inclination pattern from the rotation acceleration inclination patterns of the rotor and using the rotation acceleration inclination pattern.

According to still another characteristic of the invention, during a rotation deceleration of the rotor, second time information until the rotation of the rotor stops is displayed on the input/output unit. The second time information is a time until or when the rotation of the rotor stops.

According to still another characteristic of the invention, there is provided a centrifuge rotating a rotor at an input set rotation speed, the centrifuge including: a driving unit which rotates the rotor holding a sample; a control unit which controls the rotation of the rotor; an input/output unit which displays information thereon and receives an input from a user therethrough; and depressurization means for depressurizing a rotor chamber accommodating the rotor, wherein third time information until the rotation of the rotor is accelerated up to the set rotation speed is displayed on the input/output unit during a rotation acceleration of the rotor. The third time information is a time required until the rotor is stabilized in the centrifuge rotating at a high speed in a depressurized state, and is calculated in consideration of a time until the rotor chamber is completely depressurized and a time until the rotation of the rotor is accelerated up to the set rotation speed after the depressurization. The third time information is recalculated and displayed on the input/output unit per predetermined time (for example, per 1 minute).

According to Aspect 1 of the invention, the first time information until the rotation of the rotor is accelerated up to the set rotation speed is displayed on the input/output unit during the rotation of the rotor, and the type of the rotor determined in accordance with the separation sample or the separation condition or the different acceleration time in accordance with a difference in the operation condition such as the set rotation speed is displayed on the input/output unit. Accordingly, it is possible to provide the centrifuge which can be conveniently used by the user.

According to Aspect 2 of the invention, since the first time information is a time taken until a rotation speed of the rotor arrives at the set rotation speed, it is possible for the user to immediately recognize the estimated stabilization arrival time upon starting the rotation of the rotor or during the acceleration of the rotor.

According to Aspect 3 of the invention, since the first time information is a time when a rotation speed of the rotor arrives at the set rotation speed, it is possible for the user to immediately recognize the stabilization time.

According to Aspect 4 of the invention, since the control unit stores in advance an acceleration time taken for each type of the rotor, and calculates the first time information by identifying the rotor attached to the driving unit and reading the acceleration time taken for the identified rotor, it is possible for the user to recognize the accurate acceleration time in accordance with the type of the rotor.

According to Aspect 5 of the invention, since the control unit stores in advance a plurality of rotation acceleration inclination patterns of the rotor, and calculates the first time information by selecting the corresponding rotation acceleration inclination pattern from the rotation acceleration inclination patterns of the rotor and using the rotation acceleration inclination pattern, it is possible for the user to recognize the accurate acceleration time even when the filling state or the like of the separation sample is different.

According to Aspect 6 of the invention, since the input/output unit includes a change button which selectively displays any one of a stabilization arrival time and a stabilization time, it is possible for the user to display any favorite one of the stabilization arrival time and the stabilization time.

According to Aspect 7 of the invention, since second time information until the rotation of the rotor stops is displayed on the input/output unit during a rotation deceleration of the rotor, it is possible for the user to easily recognize the stop time of the rotor, and thus to provide the centrifuge which can be conveniently used.

According to Aspect 8 of the invention, since the second time information is a time taken until the rotation of the rotor stops, it is possible for the user to immediately recognize the stop arrival time upon stopping the rotation of the rotor or during the deceleration of the rotor.

According to Aspect 9 of the invention, since the second time information is a time when the rotation of the rotor stops, it is possible for the user to immediately recognize the stop time of the rotor upon stopping the rotation of the rotor or during the deceleration of the rotor.

According to Aspect 10 of the invention, in the centrifuge attached with the vacuum pump and rotating the rotor in a depressurized state, the third time information until the rotation of the rotor arrives at the set rotation speed is displayed on the input/output unit during the rotation acceleration of the rotor. The acceleration time obtained in consideration of the different acceleration time in accordance with a difference in the operation condition such as the set rotation speed or a difference in time until arriving at a predetermined vacuum degree is displayed on the input/output unit. Accordingly, it is possible for the user to recognize the accurate stabilization time, and thus to provide the centrifuge which can be conveniently used.

According to Aspect 11 of the invention, since the third time information is calculated in consideration of a time until the rotor chamber is completely depressurized and a time until the rotation of the rotor is accelerated up to the set rotation speed after the depressurization, it is possible to estimate the accurate acceleration time in the centrifuge attached with the vacuum pump and rotating the rotor in a depressurized state.

According to Aspect 12 of the invention, since the rotor is rotated at a limited rpm when a pressure of the rotor chamber is larger than a predetermined value, and the rotor is accelerated from the limited rpm to the set rotation speed when the pressure of the rotor chamber is not more than the predetermined value, it is possible to prevent an increase in the temperature of the sample due to the air resistance without rotating the rotor at a high speed before completing the depressurization of the rotor chamber.

According to Aspect 13 of the invention, since the third time information is a time taken until the rotation of the rotor arrives at the set rotation speed, it is possible for the user to immediately recognize the stabilization arrival time upon starting the rotation of the rotor or during the acceleration of the rotor.

According to Aspect 14 of the invention, since the third time information is a time when the rotation of the rotor arrives at the set rotation speed, it is possible for the user to immediately recognize the stabilization time of the rotor.

According to Aspect 15 of the invention, since the third time information is updated and displayed on the input/output unit per predetermined time, it is possible to highly precisely display the estimated time.

The other objects and new characteristics of the invention will be apparent in the following description of the specification and the drawings.

An object of the invention is to provide a centrifuge capable of estimating a vacuum arrival time until arriving at a predetermined vacuum degree after starting an operation of a vacuum pump, and displaying the vacuum arrival time.

Another object of the invention is to provide a centrifuge capable of highly precisely estimating a vacuum arrival time until arriving at a predetermined vacuum degree after starting an operation of a vacuum pump.

The typical characteristics of the invention disclosed herein are as below.

According to a characteristic of the invention, there is provided a centrifuge including: a motor; a rotation chamber which accommodates a rotor rotated by the motor; a vacuum pump which depressurizes a pressure of the rotation chamber by sucking air from the rotation chamber; an operation unit which receives an input from a user; a display unit which displays information thereon for the user; and a control unit which controls the operations of the motor, the rotation chamber, the vacuum pump, the operation unit, and the display unit, wherein the control unit calculates a vacuum arrival time until a predetermined vacuum degree is obtained by the vacuum pump, and displays the calculated vacuum arrival time on the display unit. The predetermined vacuum degree is a vacuum degree at which the rotor is able to be continuously rotated at an rpm set by the user without an increase in the temperature due to friction with remaining air.

According to another characteristic of the invention, the vacuum pump includes an oil diffusion vacuum pump, and the oil diffusion vacuum pump includes a boiler which accommodates operation oil, a heater which heats the operation oil, and a temperature sensor which detects a temperature of the operation oil. The control unit calculates the vacuum arrival time based on information on the temperature of the operation oil detected by the temperature sensor. In addition, the vacuum pump further includes an oil rotation vacuum pump, and a depressurizing operation is performed by the oil rotation vacuum pump until arriving at a threshold back pressure, at which the oil diffusion vacuum pump is effectively operated, from an atmospheric pressure.

According to still another characteristic of the invention, the control unit calculates the vacuum arrival time in such a manner that three divided time regions are obtained, an estimated arrival time for each of the time regions is calculated, and a sum of the estimated arrival time is obtained, where the three divided time regions include a time region (1) from a depressurization start to the threshold back pressure (about 20 Pa) of the oil diffusion vacuum pump, a time region (2) from the threshold back pressure until the temperature of the operation oil arrives at an operation temperature (about 150° C. to about 200° C.) of the oil diffusion vacuum pump, and a time region (3) until the oil diffusion vacuum pump is effectively operated and the predetermined vacuum degree (13.3 Pa) or less is obtained. At this time, storage means of the control unit stores in advance a temperature curve of the oil diffusion vacuum pump or an arrival curve of the vacuum degree inside the rotation chamber for each of the time regions (1) to (3), and the control unit calculates the estimated arrival time for each of the time regions by using the stored curves.

According to still another characteristic of the invention, the control unit compares the vacuum arrival time recalculated at a predetermined interval, and displays a message on the display unit when a change of the compared vacuum arrival time is abnormal. For example, when the state where the compared vacuum arrival time is not reduced is continued over a predetermined number of times or more, the message is displayed.

According to Aspect 16 of the invention, since the vacuum arrival time until arriving at the predetermined vacuum degree using the vacuum pump is displayed on the display unit, it is possible for the user to easily recognize the vacuum arrival time. Particularly, since the user needs not wait tediously before the centrifuge while feeling nervous, it is possible to effectively use the time.

According to Aspect 17 of the invention, since the predetermined vacuum degree is a vacuum degree at which the rotor is able to be continuously rotated at an rpm set by the user without an influence of air resistance, it is possible to easily recognize the time until the rotor is continuously rotated in a secure manner.

According to Aspect 18 of the invention, since the control unit recalculates the vacuum arrival time at a predetermined interval, and displays the recalculated vacuum arrival time on the display unit, it is possible to highly precisely display the vacuum arrival time.

According to Aspect 19 of the invention, since the vacuum pump includes an oil diffusion vacuum pump, and the control unit calculates the vacuum arrival time based on information on the temperature of the operation oil of the oil diffusion vacuum pump detected by the temperature sensor, it is possible to highly precisely estimate a portion having a large variation in the vacuum arrival time, and thus to highly precisely display the vacuum arrival time.

According to Aspect 20 of the invention, since the vacuum pump further includes an oil rotation vacuum pump, and a depressurizing operation is performed by the oil rotation vacuum pump until arriving at a threshold back pressure, at which the oil diffusion vacuum pump is effectively operated, from an atmospheric pressure, it is possible to efficiently realize the vacuum state in a short time.

According to Aspect 21 of the invention, since the control unit calculates the vacuum arrival time in such a manner that three divided time regions are obtained, an estimated arrival time for each of the time regions is calculated, and a sum of the estimated arrival time is obtained, it is possible to highly precisely calculate the vacuum arrival time.

According to Aspect 22 of the invention, since the control unit stores in advance a temperature curve of the oil diffusion vacuum pump or an arrival curve of the vacuum degree inside the rotation chamber for each of the time regions (1) to (3), and calculates the estimated arrival time for each of the time regions by using the stored curves, it is possible to simply and highly precisely calculate the vacuum arrival time.

According to Aspect 23 of the invention, since the control unit compares the vacuum arrival time recalculated at a predetermined interval, and displays a message on the display unit when a change of the compared vacuum arrival time is abnormal, it is possible to realize the abnormality occurrence notifying function in addition to the estimation of the vacuum arrival time.

According to Aspect 24 of the invention, since the control unit determines that the abnormality occurs when the state where the compared vacuum arrival time is not reduced is continued over a predetermined number of times or more, it is possible to early detect the breakage of the vacuum pump or the leakage of the pipe.

The other objects and new characteristics of the invention will be apparent in the following description of the specification and the drawings.

BEST MODE FOR CARRYING OUT INVENTION

First Embodiment

Figure 1:
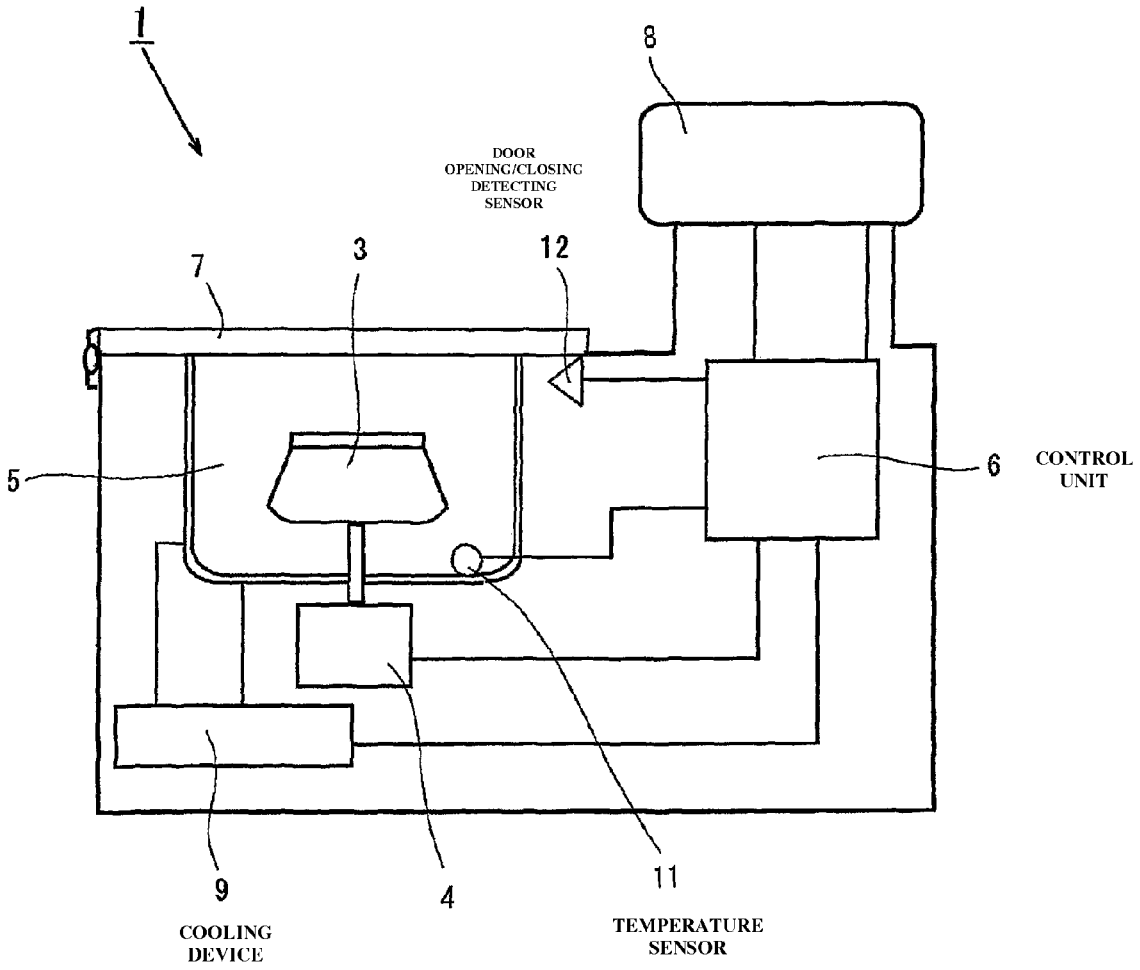
FIG. 1 is a sectional view showing a centrifuge according to a first embodiment of the invention.

Hereinafter, exemplary embodiments of the invention will be described based on the accompanying drawings. In addition, in the drawings, the same reference numerals will be given to the same constituents, and the description thereof will be omitted.

First, a basic configuration of the centrifuge according to the invention will be described with reference to FIG. 1. FIG. 1 is a sectional view showing the centrifuge in the state where a door is closed. An upper portion of a casing of a centrifuge 1 is provided with an operation/display unit 8 which is operated by a user to input information therethrough and to display required information thereon. As an operation/display unit 8, for example, a touch-panel-type liquid crystal display (LCD) device is desirably used, but an arbitrary display device or input device may be used.

The inside of the centrifuge 1 is provided with a rotation chamber 5 which accommodates a rotor 3. The rotor 3 is provided with plural holes (not shown) into which sample tubes having samples are inserted. An upper-surface opening of the rotation chamber 5 is formed to be opened or closed by a door 7. When the door 7 is opened, it is possible to attach or detach the rotor 3, accommodating the samples to be centrifugally separated, to or from the inside of the rotation chamber 5. The rotation chamber 5 is provided with a cooling device 9 which maintains the inside of the rotation chamber at a desired lower temperature. The temperature of the rotation chamber 5 is controlled by a control unit 6 based on an output of a temperature sensor 11 which is disposed inside the rotation chamber so as to measure the temperature therein. In addition, it is desirable that the temperature sensor 11 measures the same temperature as that of the sample accommodated inside the rotor 3.

The control unit 6 includes a microcomputer, a volatile storage memory, and a nonvolatile storage memory which are not shown in the drawings, and generally controls the centrifuge 1 in response to the output signals transmitted through the signal lines of the temperature sensor 11 and a door opening/closing detecting sensor 12, where the control unit performs the rotation control of a driving unit 4, the ON/OFF control of the cooling device 9, and the information display or the input data acquisition on or from the operation/display unit 13. The general control may be performed by software in such a manner that a program is executed by the microcomputer, but the invention is not limited thereto.

The control unit 6 receives operation conditions (a rotation speed, an operation time, a set temperature, and an operation rotor) set by a touch panel of the operation unit, and performs the rotation control of the driving unit 4, the temperature control of the cooling device 9, and the display of a variety of information on the operation/display unit based on the operation conditions stored in advance in a storage device inside the control unit 6 or information of the attached rotor. The control of the control unit 6 can be performed in such a manner that a program stored in storage means is executed by the microcomputer. The control unit 6 has a time function, and the control unit 6 performs the display of the current time on the operation/display unit 8 or the management of the time in a driving mode based on the time function.

A lower portion of the rotation chamber 5 is provided with a perforation hole which communicates the inside of the rotation chamber 5 with the outside thereof, and a rotation shaft extending from the driving unit 4 passes through the perforation hole so that the rotor 3 is attached to the front end of the rotation shaft. The driving unit 4 includes, for example, an electric motor, and the rotation of the electric motor is controlled by the control unit 6. In this embodiment, the rpm of the electric motor is, for example, 150,000 rpm at maximum, and the electric motor is used to rotate the rotor 3 directly attached to the output shaft of the electric motor at the uniform speed. In addition, the control unit 6 controls an ON/OFF state of a cooler included in the cooling device 9 based on the temperature detected by the temperature sensor 11 so that the temperature (set temperature) set in the operation/display unit 8 is obtained. In addition, although it is not shown in the drawings, a vacuum pump is disposed so as to be connected to the rotation chamber 5 through a pipe, and the control unit 6 may control the rotation chamber 5 so as to be depressurized in the case of operating the rotor 3.

Figure 2:
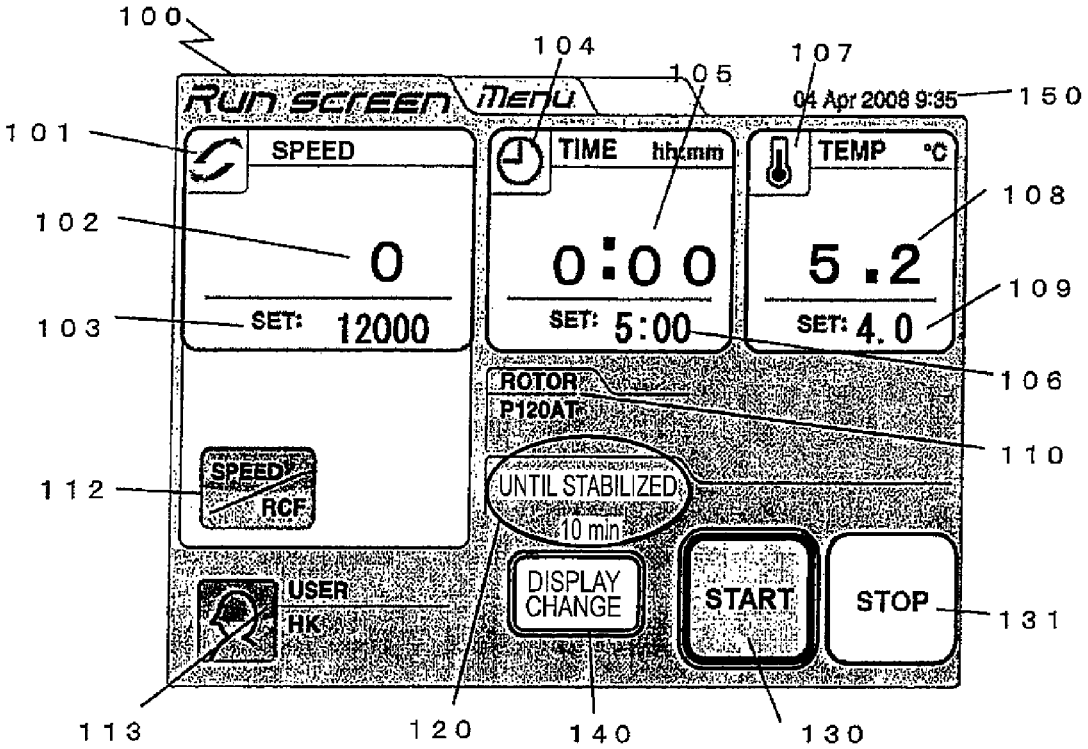
FIG. 2 is a diagram showing a screen display of an operation/display unit 8 immediately after setting an operation condition of a centrifuge 1.

Next, an operation screen displayed on the operation/display unit 8 will be described with reference to FIG. 2. FIG. 2 is a diagram showing a screen display of the operation/display unit 8 immediately after setting the operation condition of the centrifuge 1 (before pushing a start button). A display screen 100 is mainly used to display an operation state and an operation condition (setting value) of the centrifuge 1 thereon. The screen includes a rotation speed display region 101, a time display region 104, and a temperature display region 107, where the rotation speed, the time, and the temperature are the operation conditions for the centrifuge. In the vicinity of the regions, there are shown an operation rotor 110 which indicates the type of the rotor set in the rotation chamber 5, a start button 130 which is used to command the start of the centrifugal separation operation, and a stop button 131 which is used to command the stop of the rotation of the driving unit 4 or the stop of the centrifugal separation operation.

The large numeral "0" at the center of the rotation speed display region 101 indicates a current rotation speed 102 of the rotor 3, and a lower stage (small characters) defined by the lower line portion indicates a set rotation speed 103. In the example shown in FIG. 2, the set rotation speed is set to 12,000 rpm for the centrifugal separation operation. When a user's finger touches a portion within the rotation speed display region 101, a pop-up window of a numerical keyboard screen (not shown) is shown, and hence the user can set the rotation speed by operating the numerical keyboard screen.

The large numeral at the center of the time display region 104 indicates an operation time (elapsed time) 105 upon actually operating the rotor 3 at the set rotation speed 103, and is displayed by the unit of hours/minutes. FIG. 2 shows the state before performing the centrifugal separation operation, and in this state, the rotor 3 is not rotated yet. Accordingly, the operation time 105 is displayed as "0 hour and 00 minute". The operation time 105 is automatically counted and displayed by using a timer function included in the microcomputer of the control unit 6. The lower stage (small characters) defined by the lower line portion indicates a set operation time 106 for performing the centrifugal separation operation, and the set operation time is set to 5 hours and 00 minutes for the centrifugal separation operation in the example shown in FIG. 2. As in the rotation speed display region 101, when the user's finger touches a portion within the time display region 104, a pop-up window of a numerical keyboard screen (not shown) is displayed, and hence the user can set the operation time by operating the numerical keyboard screen.

The large characters at the center of the temperature display region 107 indicates a rotor temperature 108 inside the rotation chamber 5, and the lower stage (small characters) defined by the lower line portion indicates a set temperature 109 of the rotor 3 to be maintained during the centrifugal separation operation. In FIG. 2, the current rotor temperature 108 is 5.2° C., and the set temperature is 4.0° C. As in the rotation speed display region 101, when the user's finger touches a portion within the temperature display region 107, a pop-up window of a numerical keyboard screen (not shown) is displayed, and hence the user can set the operation time by operating the numerical keyboard screen.

A SPEED/RCF button 112 is a display changing button for determining whether the rotation speed (SPEED) of the rotor 3 or the centrifugal acceleration (RCF) is displayed in the rotation speed display region. Whenever the SPEED/RCF button 112 is touched, the display in the rotation speed display region 101 is changed from the rotation speed to the centrifugal acceleration, or is changed from the centrifugal acceleration to the rotation speed. A USER 113 is used to display a user name using the centrifuge 1. In the example shown in FIG. 2, "HK" is displayed as the user's initial. The user name may be selected from a user list screen (not shown), or may be input through a keyboard (not shown) displayed as a pop-up window of the operation/display unit 8. A current date 150 is displayed in the right upper portion of the screen 100.

The operation rotor 110 is used to display a type name of the operated rotor 3, and in FIG. 2, "P120AT" is displayed as a type number of the rotor 3. The rotor 3 may be set in such a manner that the user touches a portion of the rotor 110 to display a rotor list screen (not shown) and to select the rotor from the rotor list. Alternatively, the rotor 3 may be set in such a manner that the rotor 3 is allowed to have its identity information and the centrifuge 1 automatically identifies a rotor type number when the rotor 3 is set in the centrifuge 1. Since the method of automatically identifying the rotor type number may be performed by attaching an optical or magnetic bar code to the rotor or may be performed by using a known identification method, herein the description thereof will be omitted.

A stabilization arrival time 120 indicates a time from the current state until the rotation of the rotor 3 arrives at the set rotation speed 103. In the present specification, "the stabilization" indicates the state where the acceleration of the rotation of the rotor 3 ends and the rotor 3 rotates at the set rotation speed. In addition, since the display of the stabilization arrival time 120 is updated at a predetermined interval during the acceleration of the rotation of the rotor 3, the displayed value gradually decreases and becomes 0 when the rotor 3 is stabilized.

The start button 130 is a button which is used to start the operation of the centrifuge 1. When the start button 130 is touched, the rotor 3 is accelerated up to the set rotation speed 103 set in the rotation speed display region 101. When the rotor 3 arrives at the set rotation speed 103, the rotor 3 is stabilized and the operation time 105 starts to be counted. In addition, the stop button 131 is a button which is used to stop the operation of the centrifuge 1. When the stop button 131 is touched, the operation of the centrifuge 1 stops and the rotor 3 is decelerated to stop.

Figure 3:
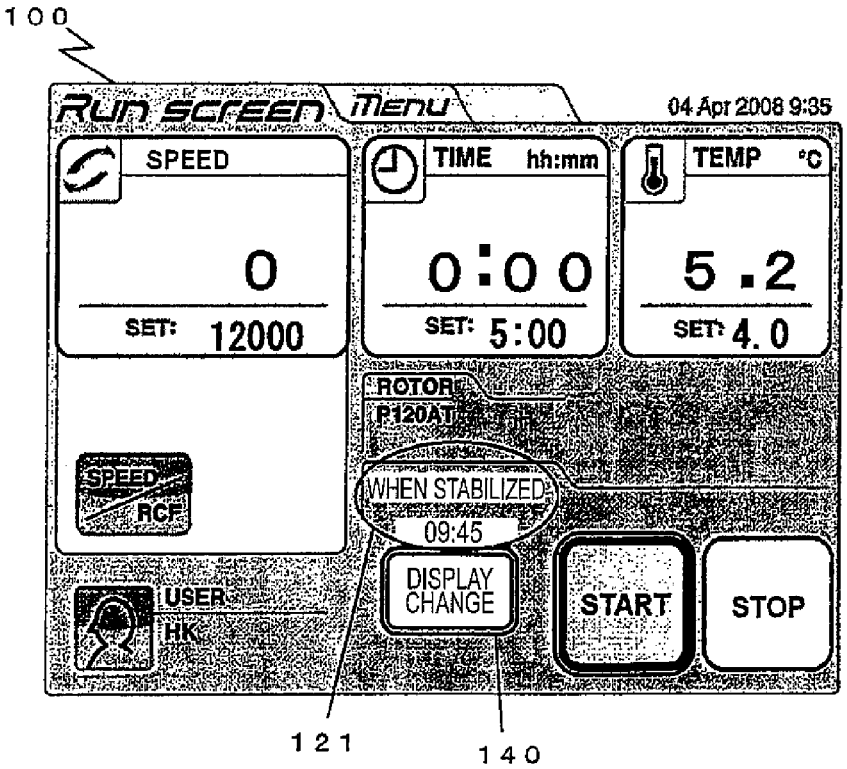
FIG. 3 is a diagram showing another screen display of the operation/display unit 8 immediately after setting the operation condition of the centrifuge 1.

A display changing button 140 has a function of changing the displays of the stabilization arrival time 120 and the stabilization time to each other. FIG. 3 is a diagram showing another screen display of the operation/display unit 8 immediately after setting the operation condition of the centrifuge 1. The example shown in FIG. 3 is different from the example shown in FIG. 2 in that the display of the stabilization time 121 is different. That is, in FIG. 2, the stabilization time is displayed as "10 minutes". In FIG. 3, "9 hours and 45 minutes" which is a time after 10 minutes is displayed instead of the stabilization time. In the time display in FIG. 3, the user needs not add the stabilization time to the current time, for example, in the case of a long time such as 35 minutes or 75 minutes, the user feels comfortable.

In addition, in this embodiment, any one of the stabilization arrival time 120 or the stabilization time 121 is displayed by using the display changing button 140 as shown in FIGS. 2 and 3. However, the display changing button 140 may be omitted, and the stabilization arrival time 120 and the stabilization time 121 may be simultaneously displayed in series. In addition, in the example shown in FIG. 2, the stabilization arrival time 120 is displayed as the time display having the unit of minute, but may be notified in more detail by the unit of minute and second.

Figure 4:
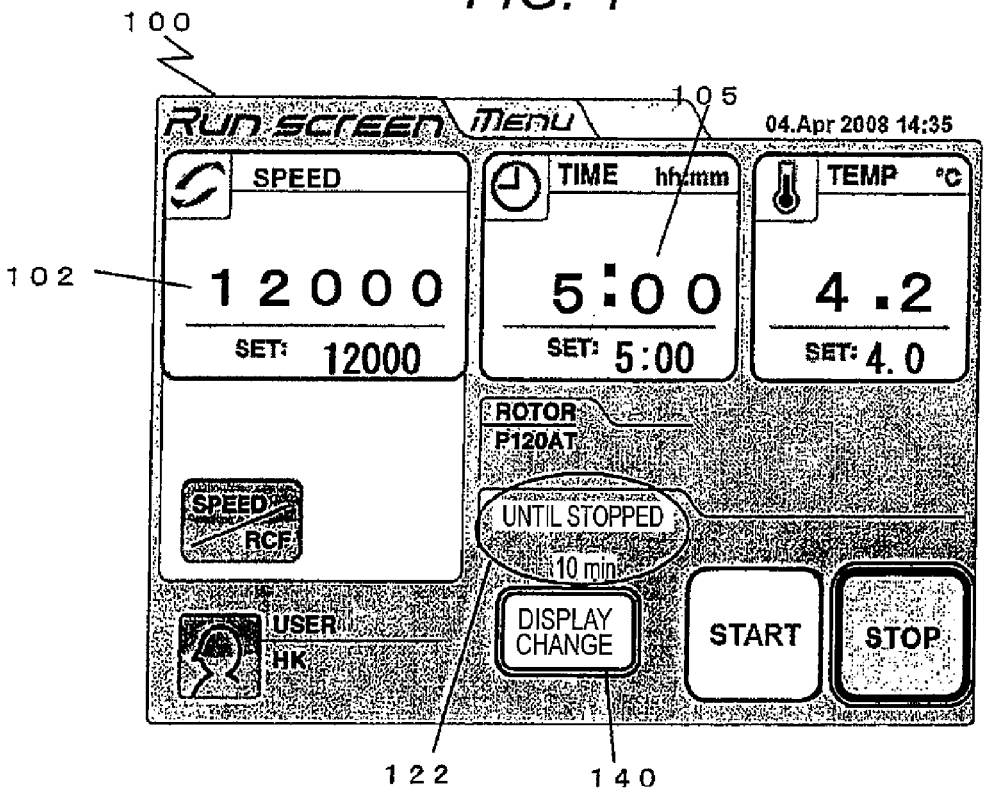
FIG. 4 is a diagram showing a screen display of the operation/display unit 8 when an operation of the centrifuge 1 for a set operation time 106 ends and a rotor 3 starts to be decelerated.

FIG. 4 is a diagram showing the screen display of the operation/display unit 8 when an operation of the centrifuge 1 for a set operation time 106 ends and the rotor 3 starts to be decelerated. The example shown in FIG. 4 is mainly different from the example shown in FIG. 2 in that the current rotation speed 102 of the rotor 3 is 12,000 rpm due to the stabilization state before the deceleration and the centrifugal separation operation time 105 is "5 hours and 00 minute". In addition, in FIG. 4, the display of the stabilization arrival time 120 in FIG. 2 is changed to a stop arrival time 122. The stop arrival time 122 of the rotor 3 gradually decreases with time during the deceleration of the rotor 3, and becomes 0 minute in a stop state. In addition, the update interval of the stop arrival time 122 may be arbitrarily set. That is, the update interval may be set to be long when the stop arrival time is long, and may be set to be short when the stop arrival time is short (for example, within 60 seconds).

Figure 5:
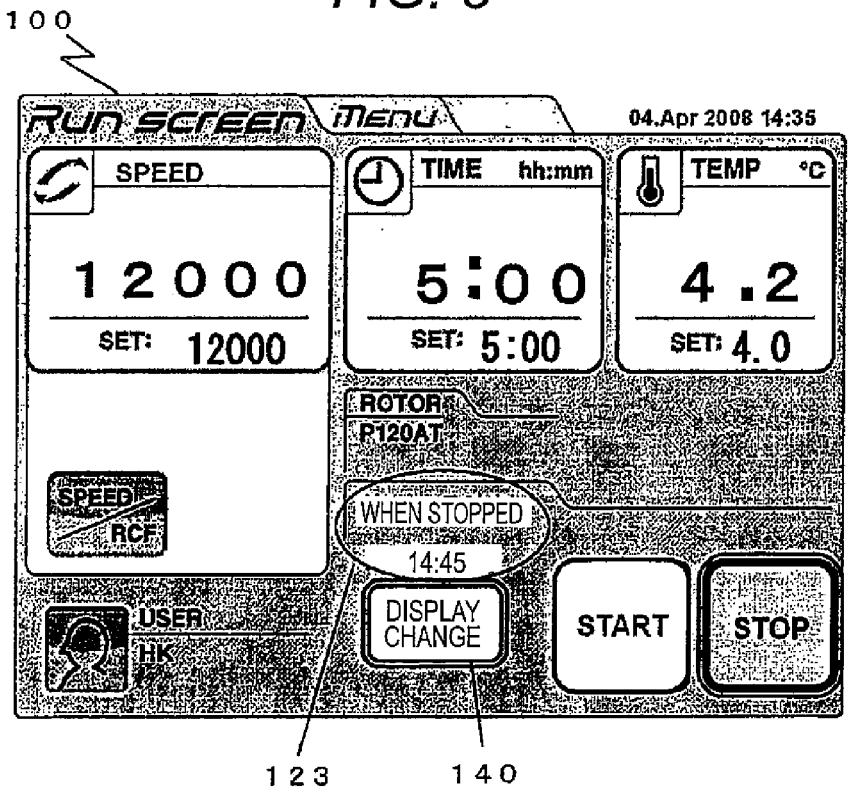
FIG. 5 is a diagram showing another screen display of the operation/display unit 8 when an operation of the centrifuge 1 for the set operation time 106 ends and the rotor 3 starts to be decelerated.

The display changing button 140 has a function of changing the displays of the stop arrival time 120 and the stop time to each other. FIG. 5 is a diagram showing another screen display of the operation/display unit 8 when the operation of the centrifuge 1 for the set operation time 106 ends and the rotor 3 starts to be decelerated. The example shown in FIG. 5 is different from the example shown in FIG. 4 in that the display of the stop time 123 is different. That is, in FIG. 4, the stop time is displayed as "10 minutes". In FIG. 5, "14 hours and 45 minutes" which is a time after 10 minutes is displayed instead of the stop time. In addition, the stop arrival time 122 and the stop time 123 may be simultaneously displayed in series.

Figure 6:
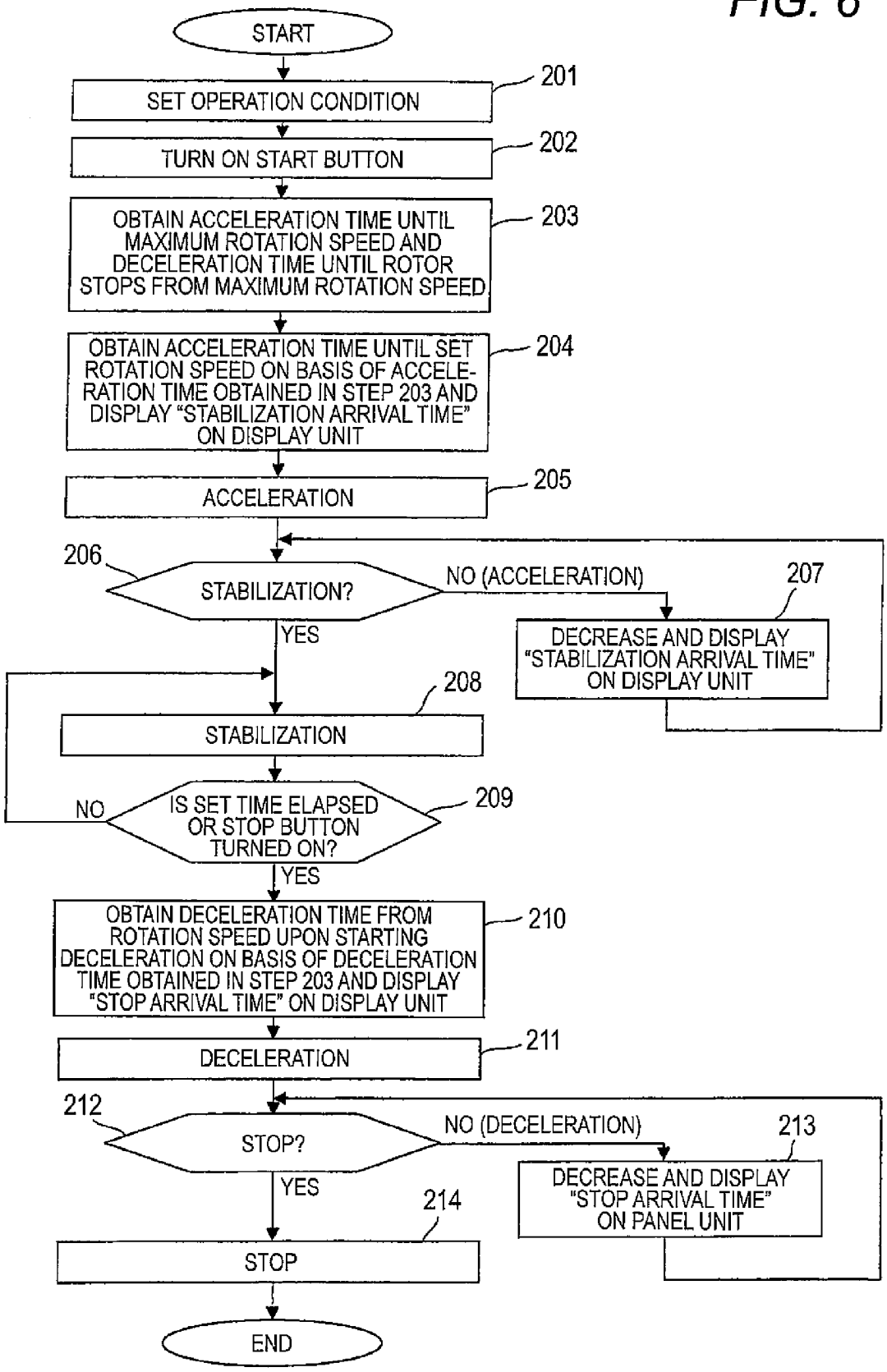
FIG. 6 is a flowchart showing an operation of the centrifuge according to the first embodiment.

Next, a display sequence of the operation/display unit 8 in accordance with the operation state of the centrifuge 1 will be described with reference to a flowchart shown in FIG. 6. First, before performing the centrifugal separation operation, the user sets the rotor 3 attached with the sample in the inside of the rotation chamber 5 and closes the door 7. Subsequently, the user inputs the operation conditions such as the set rotation speed 103, the set operation time 106, the set temperature 109, and the type of the operation rotor 110 through the screen 100 of the operation/display unit 8, and the control unit 6 receives the information (Step 201). Subsequently, when the user pushes the start button 130 (Step 202), the control unit 6 obtains the acceleration time until the rotor 3 arrives at the set rotation speed (maximum rotation speed) 103 and the deceleration time from the maximum rotation speed until the rotor 3 stops based on the type of the set operation rotor 110 and a table stored in advance in the storage device of the control unit 6 (Step 203).

Next, an exemplary case will be described in which the acceleration time until the set rotation speed 103 is obtained by a proportional expression based on the acceleration time until the maximum rotation speed. If the acceleration time stored in the storage device is a time required for, for example, 0 to 15,000 rpm, in the case of 12,000 rpm in the stabilization state as in this embodiment, the stabilization time until arriving at the 12,000 rpm is obtained by using the proportional expression, and the obtained time is displayed on a panel display unit (Step 204). Since the stabilization arrival time or the stop arrival time is obtained from the rotor information for each rotor stored in advance in the storage device, a reference may be inaccurately displayed due to a difference in the acceleration or deceleration, but the time/date display which is used as a reference for the user can be more comfortably and effectively used. Subsequently, the rotor 3 starts to be accelerated (Step 205). In addition, in the case of more accurately displaying the time and date until arriving at the stabilization and the stop, the time and date may be updated and displayed by periodically obtaining the time and date by using the acceleration inclination during the acceleration or the deceleration inclination during the deceleration. That is, the acceleration curve upon activating the rotor 3 and the deceleration curve of the rotor 3 are stored in the storage device of the control unit 6, the corresponding acceleration (deceleration) curve is compared upon actually starting the rotation (deceleration) of the rotor 3, and then the time until arriving at the stabilization (the time until arriving at the stop) is calculated based on the acceleration (deceleration) curve selected by the comparison. Alternatively, the set rotation speed or the stop arrival time may be calculated based on the time until accelerating or decelerating to a predetermined rotation speed (for example, 1,000 rpm).

Subsequently, the control unit 6 determines whether the rpm of the rotor 3 is stabilized at the set rotation speed (Step 206). In the case where the stabilization is not realized, that is, the rotation of the rotor 3 is accelerated, the stabilization arrival time displayed in Step 204 decreases per minute and the display thereof is updated (Step 207), and the current step returns to Step 206. When it is determined that the stabilization is realized in Step 206, the centrifugal separation operation is performed for the time set for the stabilization state (Step 208). Here, when the step moves from Step 206 to Step 208, the display of the stabilization arrival time 120 becomes "0 minute". The display may be omitted instead of "0 minute", and "the stabilization" may be displayed instead of the display of the stabilization arrival time 120.

When the operation time arrives at the set time or the stop button of the operation panel is pushed in the stabilization state (Step 209), the deceleration time is obtained based on the deceleration time from the maximum rotation speed to the stop state obtained in Step 203, and the stop time 122 shown in FIG. 3 or the stop time 123 shown in FIG. 4 is displayed on the operation/display unit 8 (Step 210). Subsequently, it is determined whether the rotor 3 stops (Step 212). In the case where the rotor is not in a stop state, the stop arrival time decreases per minute and is displayed on the operation/display unit 8 (Step 213), and the current step returns to Step 212. When the rotor is in a stop state in Step 212, the current process ends by performing a process (for example, a process of making an end buzzer sound) required for the stop (Step 214). In addition, in the state in Step 214, the stop arrival time 122 (FIG. 4) becomes "0 minute" when the rotation of the rotor stops. The display may be omitted instead of "0 minute", and "the stop" may be displayed instead of the display of the stop arrival time 122.

As described above, according to this embodiment, since "the stabilization arrival time" until the rotor is stabilized at the set rotation speed after starting the operation of the centrifuge or "the stop arrival time" until the rotor stops from the stabilization state is displayed on the operation/display unit 8, it is possible for the user of the centrifuge 1 to accurately recognize the operation state of the centrifuge. Accordingly, since it is possible to prevent the user from unthinkingly waiting before the centrifuge while uselessly spending time, the user can more conveniently use the centrifuge.

Second Embodiment

Figure 7:
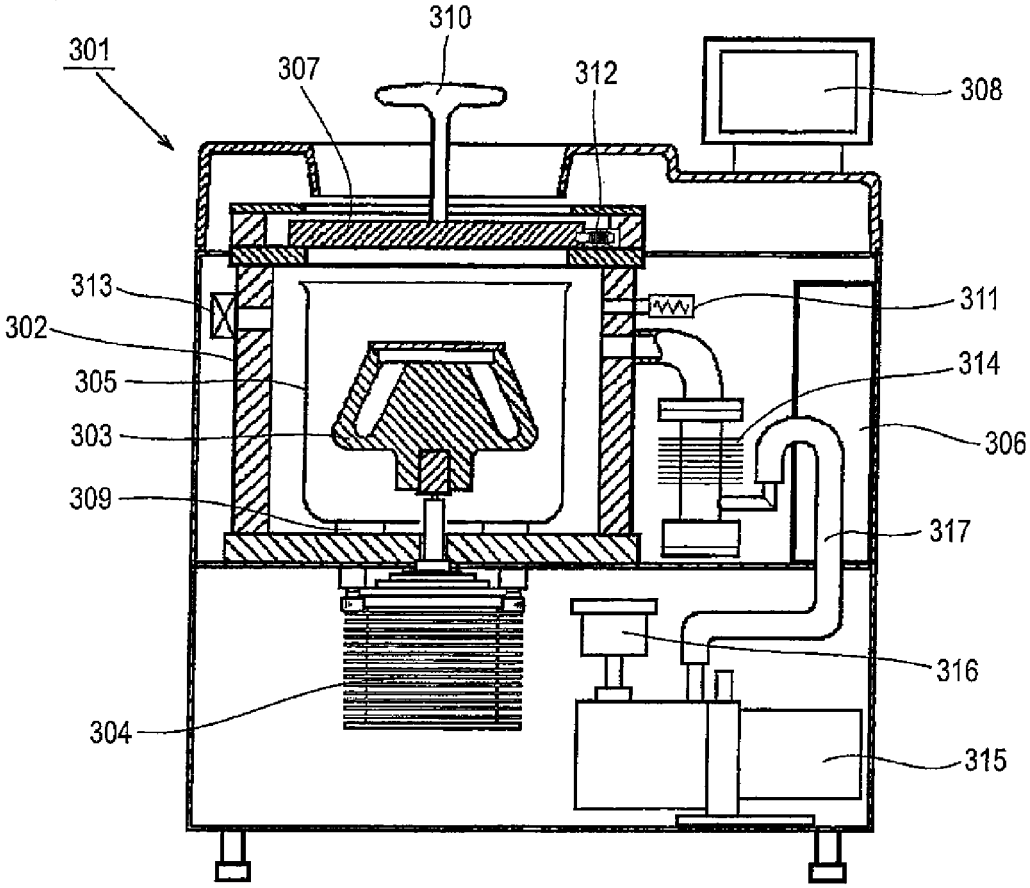
FIG. 7 is a sectional view showing the centrifuge according to a second embodiment of the invention.

Next, a second embodiment of the invention will be described with reference to FIGS. 7 to 17. FIG. 7 is a sectional view showing a configuration of the centrifuge according to the second embodiment. A basic configuration of a centrifuge 301 is substantially the same as that of the first embodiment, but the second embodiment has a largely different configuration in which a vacuum pump (314 and 315) is disposed so as to depressurize and rotate a rotation chamber 305 and a rotor 303 is rotated in a depressurized state. For this reason, it is necessary to estimate the stabilization arrival time in consideration of the time required for the acceleration of the rotor and the depressurization of the rotation chamber 305.

The centrifuge 301 includes the rotor 303 which rotates while holding a sample; a rotation chamber 305 which accommodates the rotor 303; a vacuum chamber 302 which surrounds the rotation chamber 305 so as to form a hermetic space; a door 307 which is used to close an opening formed to insert or extract the rotor 303 into or from the vacuum chamber 302; an oil rotation vacuum pump 315 which depressurizes the inside of the vacuum chamber 302; an oil diffusion vacuum pump 314 which is connected in serial between the oil rotation vacuum pump 315 and the vacuum chamber 302; an operation/display unit 308 which is used by a user to set a condition of a centrifugal separation operation or to check an operation state thereof; a driving unit 304 which rotates the rotor 303; an air leak valve 313 which enables or disables the entry of air to the vacuum chamber 302; a vacuum sensor 311 which measures a pressure inside the vacuum chamber 302; a control unit 306; a door lock mechanism 312 which locks the door 307 so as not to be opened; a door handle 310 which is used to open the door 307; and a thermo module 309 which cools or heats the rotation chamber 305.

The suction-side portion of the oil diffusion vacuum pump 314 is connected to the rotation chamber 305, and the discharge-side portion thereof is connected to a suction port of the oil rotation vacuum pump 315 through a vacuum pipe 317. The oil diffusion vacuum pump 314 is a known device which has liquid oil therein and air inside the rotation chamber 305 is discharged to the outside by the evaporation and condensation inside the oil. In this embodiment, as the vacuum pump, the oil diffusion vacuum pump 314 is connected in serial to the oil rotation vacuum pump 315. This is because one or two days are taken to obtain a predetermined vacuum degree (for example, a pressure of 1 Pa or less) by using only the oil rotation vacuum pump 315 and a predetermined back pressure (threshold back pressure: about 20 Pa) is required to operate the oil diffusion vacuum pump 314. For this reason, it is necessary to provide an auxiliary pump for obtaining the threshold back pressure. That is, the oil rotation vacuum pump 315 serves as an auxiliary pump for the oil diffusion vacuum pump 314. The discharge-side portion of the oil rotation vacuum pump 315 is provided with an oil mist trap 316 used for supplementing the oil mist contained in an exhaust gas.

The oil diffusion vacuum pump 314 is provided with a DP boiler which accommodates operation oil therein and a DP heater which heats the operation oil (which are not shown in the drawings). The temperature of the operation oil is measured by a temperature sensor (not shown). The operation oil heated by the DP heater rises in the inside of a chimney (not shown) inside the oil diffusion vacuum pump, and is discharged as vapor from a nozzle disposed in the chimney and obliquely facing the DP boiler. When gas molecules such as air collide with the vapor, the air is moved in a direction of the stream of the vapor, and flows to the discharge-side portion. Subsequently, the air inside the rotation chamber 305 connected to the oil diffusion vacuum pump is discharged to the outside, and the inside of the rotation chamber 305 becomes a depressurized state. The operation oil changed to the vapor is condensed and collected at a wall surface of the DP boiler, and is heated again by the DP heater. The information on the temperature of the operation oil detected by the temperature sensor is input to the control unit 306 through a signal line (not shown).

The control unit 306 includes a microcomputer, and generally controls the centrifuge 301 in response to the output signals transmitted through a signal line (not shown) of the vacuum sensor 311, where the control unit performs the rotation control of the driving unit 304, the ON/OFF control of the oil rotation vacuum pump 315, the ON/OFF control of the oil diffusion vacuum pump 314, the information display on the operation/display unit 308, the input data acquisition through the operation/display unit 308, the control of the door opening/closing detecting sensor (not shown) which detects the locking state of the door lock, and the opening/closing control of the air leak valve 313. The operation/display unit 308 is, for example, touch-panel-type liquid crystal display means or means obtained by combining a display device with an input device, and is used to display information required for the user thereon and to receive an operation command from the user. In addition, the control unit 306 is able to calculate the vacuum arrival time based on the temperature information. The control unit 306 stores in advance the vacuum arrival curve of the rotation chamber and the temperature curve of the oil diffusion vacuum pump 314, and calculates the estimated arrival time for each of time regions based on the stored curves.

Figure 8:
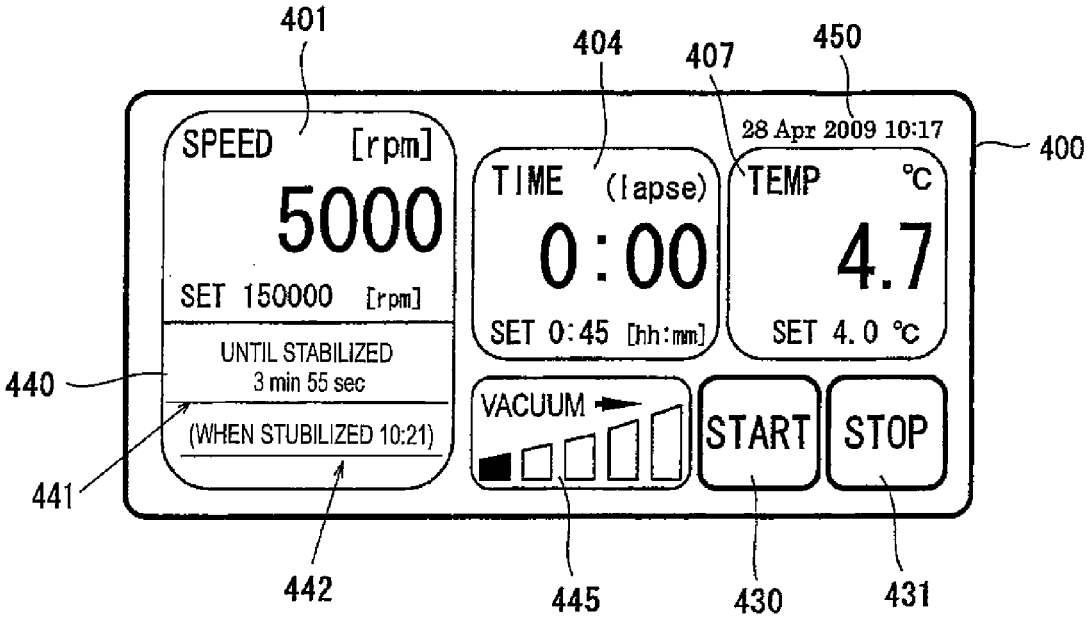
FIG. 8 is a diagram showing a screen display of an operation/display unit 308 of a centrifuge 301.

Next, the display content of the operation/display unit 308 will be described with reference to FIG. 8. FIG. 8 shows a display screen 400 of the operation/display unit 308, and in this embodiment, an example will be described in which the operation/display unit 308 is configured as a touch-panel-type liquid crystal display unit. The display screen 400 includes a rotation speed display region 401, an operation time display region 404, a temperature display region 407, a date display region 450, and a vacuum arrival display region 445, where the respective regions display the condition of the centrifugal separation operation and a variety of information during the centrifugal separation operation. The display screen 400 further includes a start button 430 and a stop button 431. The set rotation speed for the centrifugal separation operation is displayed in the lower stage of the rotation speed display region 401, and the large characters thereabove indicates the current rpm of the rotor 303. FIG. 8 shows a state where the set rotation speed is 150,000 rpm and the rotor now rotates at 5,000 rpm. The set operation time is displayed in the lower stage of the operation time display region 404, and the large characters thereabove indicates the current elapsed operation time. FIG. 8 shows a state where the set operation time for the centrifugal separation operation is 45 minutes and the current elapsed time is 0 minute. The set temperature is displayed in the lower stage of the temperature display region 407, and the large characters thereabove indicates the current rotor temperature. FIG. 8 shows a state where the set temperature is 4.0° C. and the current temperature is 4.7° C. In addition, third time information which is a characteristic of this embodiment, that is, "an estimated stabilization arrival time 441" and "an estimated time (arriving at the stabilization) 442" are displayed in an estimated waiting time display region 440.

Since the centrifuge 301 according to the second embodiment includes two vacuum pumps (314 and 315), the vacuum degree inside the vacuum chamber 302 is displayed using 5-stage bars in a vacuum degree display region 445. FIG. 8 shows a state where only the leftmost bar is displayed. As the number of displayed bars increases, the vacuum degree increases (the pressure inside the vacuum chamber 302 decreases).

Figure 9:
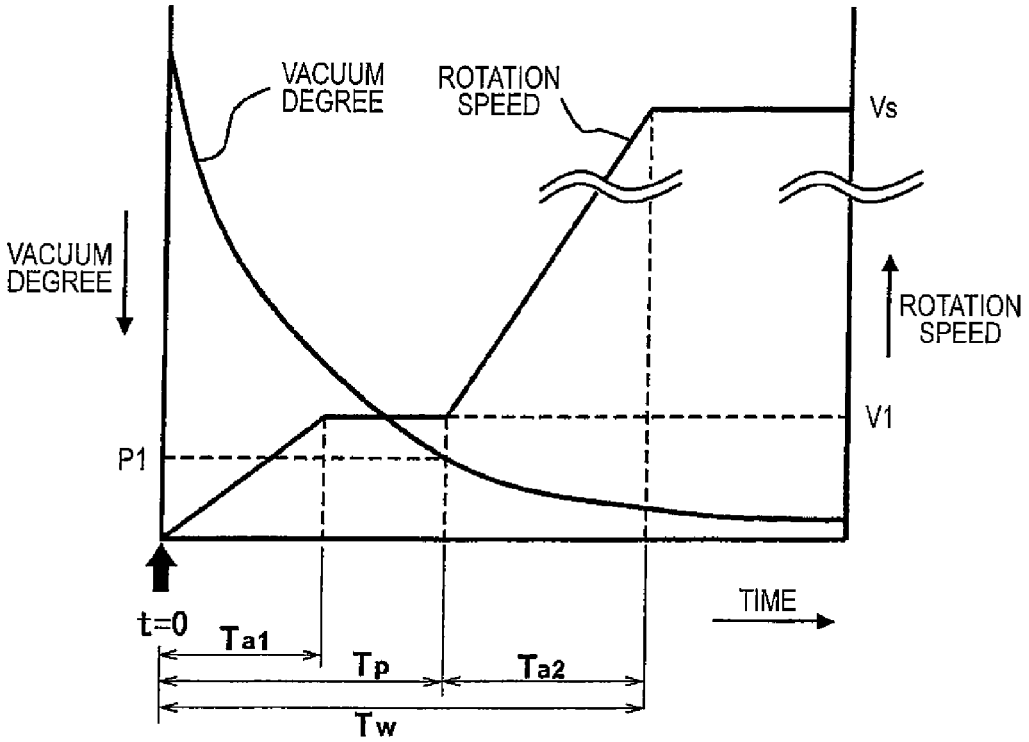
FIG. 9 is a (first) timing chart showing a relationship between a time and a rotation speed of a rotor 303 and a relationship between a time and a vacuum degree until the rotor 303 arrives at a set rotation speed after starting an operation of a centrifuge 301.

Next, a method of calculating "an estimated stabilization arrival time" according to the second embodiment will be described with reference to FIGS. 9 to 12. FIG. 9 is a timing chart showing a relationship between the time and the rotation speed of the rotor 303 and a relationship between the time and the vacuum degree until the rotor 303 arrives at the set rotation speed after starting the operation of the centrifuge 301. The centrifuge 301 has such a function that the centrifuge waits without accelerating at a predetermined rotation speed V1 (unit: rpm) or more until the vacuum degree inside the rotation chamber 305 arrives at a predetermined value P1 (unit: Pa). In this embodiment, for example, in the case where a rotation speed Vs set for the centrifugal separation operation is 150,000 rpm, the rotation speed V1 is set to 5,000 rpm. This is because the possibility of an increase in the temperature of the rotor 303 due to the air resistance is low in the case of the low rotation speed of about 5,000 rpm. In addition, the vacuum degree P1 is set to, for example, 13.3 Pa.

In this embodiment (FIGS. 9 to 12), assuming that the estimated time until the rotation speed of the rotor 303 arrives at the rotation speed V1 is denoted by Ta1, the estimated acceleration time from the rotation speed V1 until the set rotation speed Vs is denoted by Ta2, and the estimated time until the vacuum degree arrives at the vacuum degree P1 is denoted by Tp, in the case of the time point (time t=0) depicted by the black arrow in FIG. 9, the estimated total time Tw until the rotor 303 arrives at the set rotation speed Vs after activating the driving unit 304 is a value obtained by adding Tp to Ta2. In the example shown in FIG. 9, since the estimated time Tp until arriving at the predetermined vacuum degree P1 is longer than the estimated time Ta1 until the rotation speed of the rotor 303 arrives at the rotation speed V1, the rotor 303 is maintained in a waiting state while rotating at a fixed low rotation speed V1 for "Tp−Ta1". In addition, in the case where the vacuum degree inside the rotation chamber 305 is not less than the vacuum degree P1 (that is, P1 Pa or less), the rotor 303 accelerates from the rotation speed V1 to the rotation speed Vs.

Various methods of calculating the estimated time Tp until the vacuum degree inside the vacuum chamber 302 arrives at the vacuum degree P1 may be considered. In this embodiment, the control unit 306 calculates the estimated time Tp in such a manner that three divided time regions are obtained, an estimated arrival time for each of the time regions is calculated, and a sum of the estimated arrival time is obtained, where the three divided time regions include a time region (1) from a depressurization start to the threshold back pressure (about 20 Pa) of the oil diffusion vacuum pump 314, a time region (2) from the threshold back pressure until the temperature of the operation oil arrives at an operation temperature (about 150° C. to about 200° C.) of the oil diffusion vacuum pump 314, and a time region (3) until the oil diffusion vacuum pump 314 is effectively operated and the predetermined vacuum degree (13.3 Pa) or less is obtained. At this time, storage means of the control unit 306 stores in advance a temperature curve of the oil diffusion vacuum pump 314 or an arrival curve of the vacuum degree inside the rotation chamber 305 for each of the time regions (1) to (3). The control unit 306 calculates the estimated arrival time for each of the time regions by comparing various measured data with the stored curves, and calculates the estimated time Tp based on the sum thereof.

Figure 10:
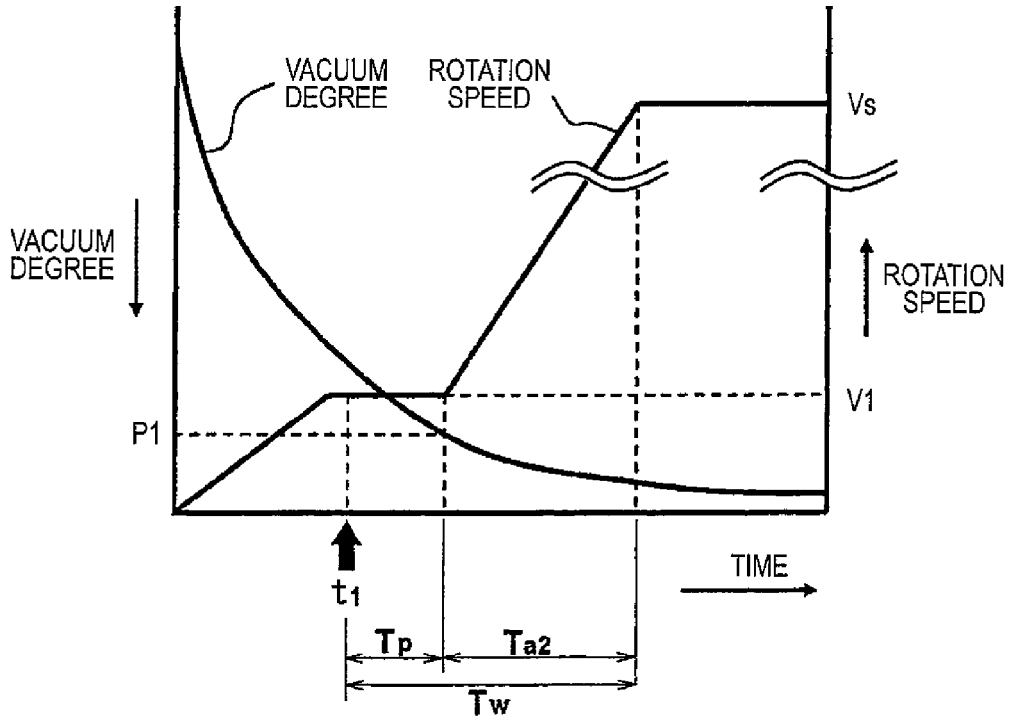
FIG. 10 is a (second) timing chart showing a relationship between a time and a rotation speed of the rotor 303 and a relationship between a time and a vacuum degree until the rotor 303 arrives at a set rotation speed after starting an operation of the centrifuge 301.

FIG. 10 is a diagram illustrating the estimated total time Tw at the time point (time point $t_1$) depicted by the black arrow in the centrifuge 301 having the relationship shown in FIG. 9. At the time point $t_1$, the rotor 303 uniformly rotates at the rotation speed V1, and is maintained in a waiting state until the vacuum degree inside the rotation chamber 305 arrives at the predetermined vacuum degree P1. Accordingly, each waiting time changes with time. For example, in the case where the rotor is maintained in the waiting state while rotating at the rotation speed V1 until the vacuum degree arrives at the vacuum degree P1, the estimated time Tp decreases, and the estimated total time Tw at this time point is a value obtained by adding Tp to Ta2.

Figure 11:
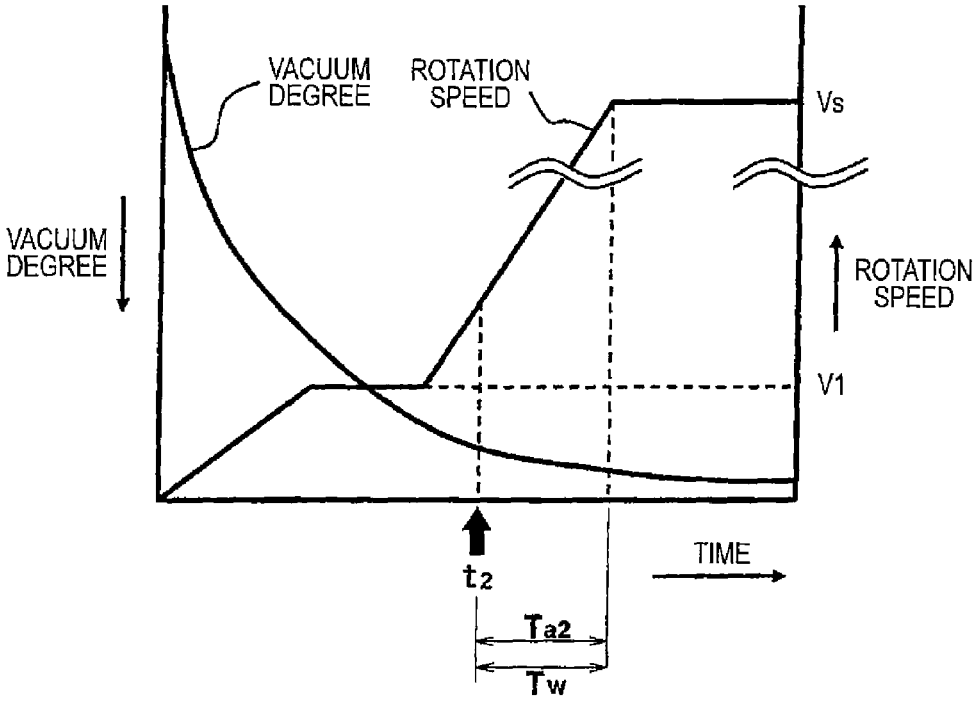
FIG. 11 is a (third) timing chart showing a relationship between a time and a rotation speed of the rotor 303 and a relationship between a time and a vacuum degree until the rotor 303 arrives at a set rotation speed after starting an operation of the centrifuge 301.

FIG. 11 is a diagram showing the waiting time relationship at the time point $t_2$ when the vacuum degree inside the rotation chamber 305 becomes P1 or more (that is, P1 Pa or less) and the rotor 303 further accelerates. At the time point $t_2$, since the rotation speed of the rotor 303 arrives at the rotation speed V1 and the vacuum degree inside the vacuum chamber 302 arrives at the vacuum degree P1, the waiting time Tw is equal to Ta2.

Figure 12:
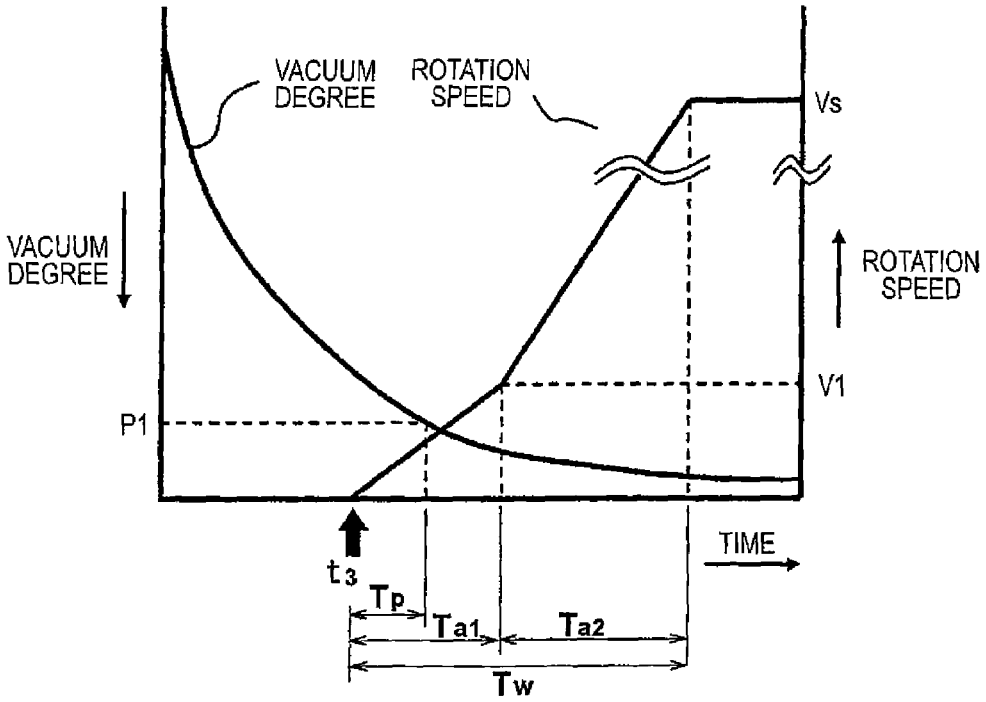
FIG. 12 is a (fourth) timing chart showing a relationship between a time and a rotation speed of the rotor 303 and a relationship between a time and a vacuum degree until the rotor 303 arrives at a set rotation speed after starting an operation of the centrifuge 301.

FIG. 12 is a diagram illustrating a method of calculating "the estimated stabilization arrival time" in a state different from the states shown in FIGS. 9 to 11. In the centrifuge 301, in order to reduce the time for the centrifugal separation operation, the user starts the rotation of the rotor 303 by pushing the start button 430 (see FIG. 8) (at the time point $t_3$) after a predetermined time is elapsed from the time when activating the vacuum pump, where the time point $t_3$ corresponds to the case where the user operates the vacuum pump in advance and starts the operation (the rotation of the rotor 303) after a predetermined time. In this state, since Tp is shorter than Ta1, the relationship of Ta1, Ta2, and Tp is obtained as shown in the drawing, where the estimated time until the rotation speed of the rotor 303 arrives at the rotation speed V1 is denoted by Ta1, the estimated acceleration time until the rotation speed of the rotor changes from the rotation speed V1 to the set rotation speed Vs is denoted by Ta2, and the estimated time until the vacuum degree arrives at the vacuum degree P1 is denoted by Tp. In the case of the relationship shown in FIG. 12, the estimated total time Tw until arriving at the stabilization is a value obtained by adding Ta1 to Ta2.

Next, a display sequence of the operation/display unit 308 in accordance with the operation state of the centrifuge 301 will be described with reference to a flowchart shown in FIG. 13. First, before performing the centrifugal separation operation, the user sets the rotor 303 attached with the sample in the inside of the rotation chamber 305 and closes the door 307. Subsequently, the user inputs the operation conditions such as the set rotation speed, the set operation time, and the set temperature, and through the screen 400 of the operation/display unit 308, and the control unit 306 receives the information (Step 501). Subsequently, when the user pushes the start button 430 (Step 502), the control unit 306 locks the door 307 by using the door lock mechanism 312, and obtains the acceleration time (total estimated time Tw) until the rotation speed of the rotor 303 arrives at the set rotation speed. For the estimated total time Tw, the acceleration time (Ta1 and Ta2) until arriving at the set rotation speed (maximum rotation speed) of the rotor 303 is obtained from the type name of the attached operation rotor based on the table stored in advance in the storage device of the control unit 6 (Step 503). In addition, the estimated time Tp until the vacuum degree inside the vacuum chamber 302 arrives at the vacuum degree P1 is calculated based on the vacuum degree arrival curve or the temperature curve of the oil diffusion vacuum pump 314.

A method of obtaining the acceleration time (estimated total time Tw) will be described further with reference to FIG. 14. FIG. 14 is a flowchart showing a detailed sequence (subroutine) of Step 503 in FIG. 13. In the subroutine shown in FIG. 14, when the operation of the centrifuge 301 starts, first, it is determined whether the rotation speed of the rotor 303 arrives at the predetermined rotation speed V1 (Step 601). In the case where the rotation speed does not arrive at the predetermined rotation speed V1, the estimated time Tp until the vacuum degree arrives at the predetermined value, the estimated time Ta1 until the rotation speed arrives at the rotation speed V1, and the estimated time Ta2 until the rotation speed changes from the rotation speed V1 to the rotation speed Vs are calculated (Step 602). The method of calculating the estimated vacuum arrival time is not limited thereto, but a method of using the temperature of the oil diffusion vacuum pump or using the previously stored vacuum arrival curve may be used as in the known example. In addition, even in the method of calculating estimated time until the rotor accelerates up to the set rotation speed, a known method may be used.

Next, Tp is compared with Ta1 (Step 603). In the case where Tp is larger than Ta1, Tw is obtained by adding Tp and Ta2 (Step 604). In the case where Tp is not larger than Ta1, Tw is obtained by adding Ta1 to Ta2 (Step 605). Meanwhile, when it is determined that the rotation speed is not less than the rotation speed V1 in Step 601, Ta2 is calculated (Step 606), and Tw is set to the value of Ta2 (Step 607). Finally, the estimated total time Tw calculated as described above is held, and the current step moves to Step 504 shown in FIG. 13.

Figure 13:
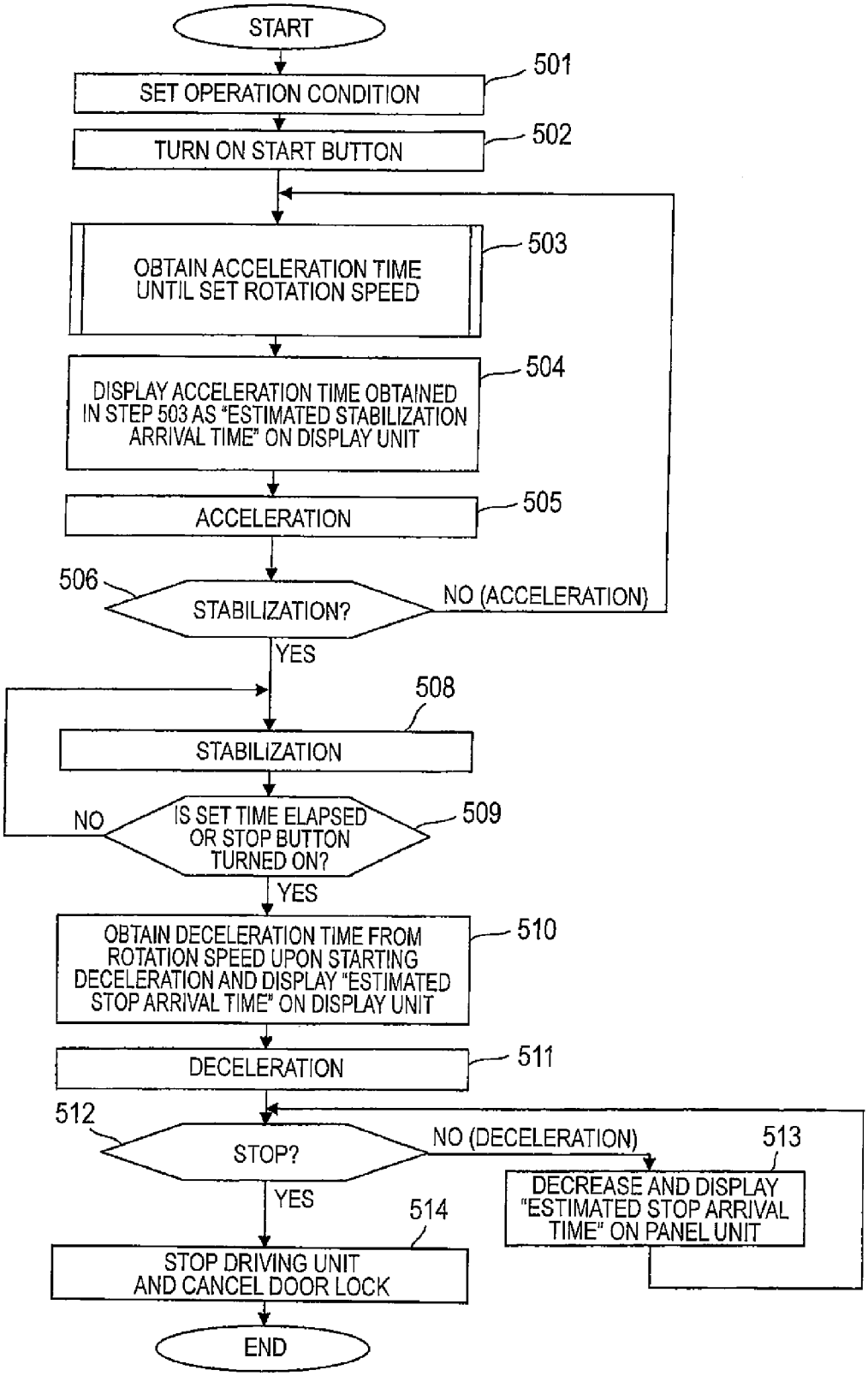
FIG. 13 is a flowchart showing an operation of the centrifuge according to the second embodiment.
Figure 14:
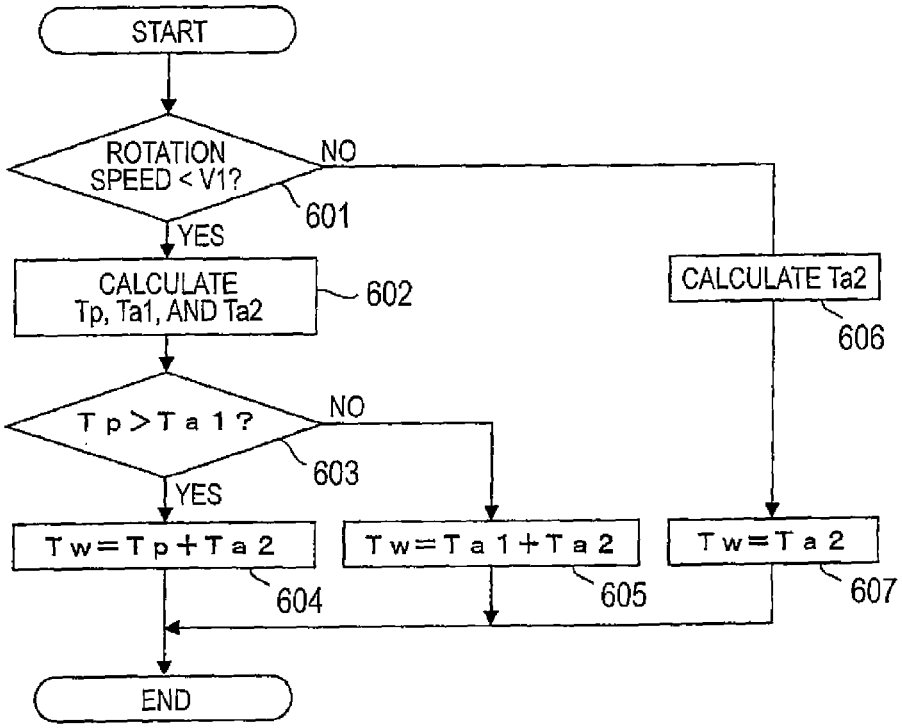
FIG. 14 is a flowchart showing a detailed sequence (subroutine) of Step 503 of the flowchart in FIG. 13.

Subsequently, the stabilization arrival time (estimated total time Tw) required in FIG. 13 is displayed in the estimated waiting time display region 440 of the display screen 400 (Step 504), and the acceleration of the rotor 303 is performed (Step 505). Subsequently, the control unit 306 determines whether the rpm of the rotor 303 is stabilized at the set rotation speed Vs (Step 506). In the case where the stabilization is not obtained yet, that is, the acceleration of the rotor 303 is still performed, the current step returns to Step 503. When it is determined that the stabilization is obtained in Step 506, the centrifugal separation is performed for a time set in the stabilization time (Step 508). Here, the display content of the estimated stabilization arrival time 441 is "0 minute" when the step moves from Step 506 to Step 508. In this case, "the stabilization" may be displayed instead of "0 minute", or the display may be removed.

In the stabilization state, when the operation time arrives at the set time or the stop button of the operation panel is pushed (Step 509), the deceleration time from the maximum rotation speed to the stop is obtained, and the estimated stop arrival time is displayed on the operation/display unit 308 (Step 510). Subsequently, it is determined whether the rotor 303 stops (Step 512). In the case where the rotor 303 is not in a stop state, the stop arrival time decreasing per minute is displayed on the operation/display unit 308 (Step 513), and the current step returns to Step 512. In the case where the rotor is in a stop state in Step 512, a process required for the stop, for example, a process of making an end buzzer sound is performed, the rotation of the driving unit 304 stops, and then the door lock is canceled when the rotation of the driving unit 304 stops (Step 514). The user pushes a vacuum button (not shown) displayed on the operation/display unit 308 so as to activate the air leak valve 313 and leaks air to the vacuum chamber 302. Since the air leaking operation ends after several seconds, it is possible to open the door 307 after the end of the air leaking operation.

As described above, since the stabilization arrival time is displayed in the centrifuge using the vacuum pump according to the second embodiment, it is possible for the user to accurately recognize the acceleration time until arriving at the stabilization state. In addition, since it is possible to highly precisely estimate the acceleration time in consideration of the state (whether the current state is immediately after the precedent centrifugal separation operation or any condensation is attached) inside the vacuum chamber 302, it is possible to realize the centrifuge which can be easily used by the user.

Figure 15:
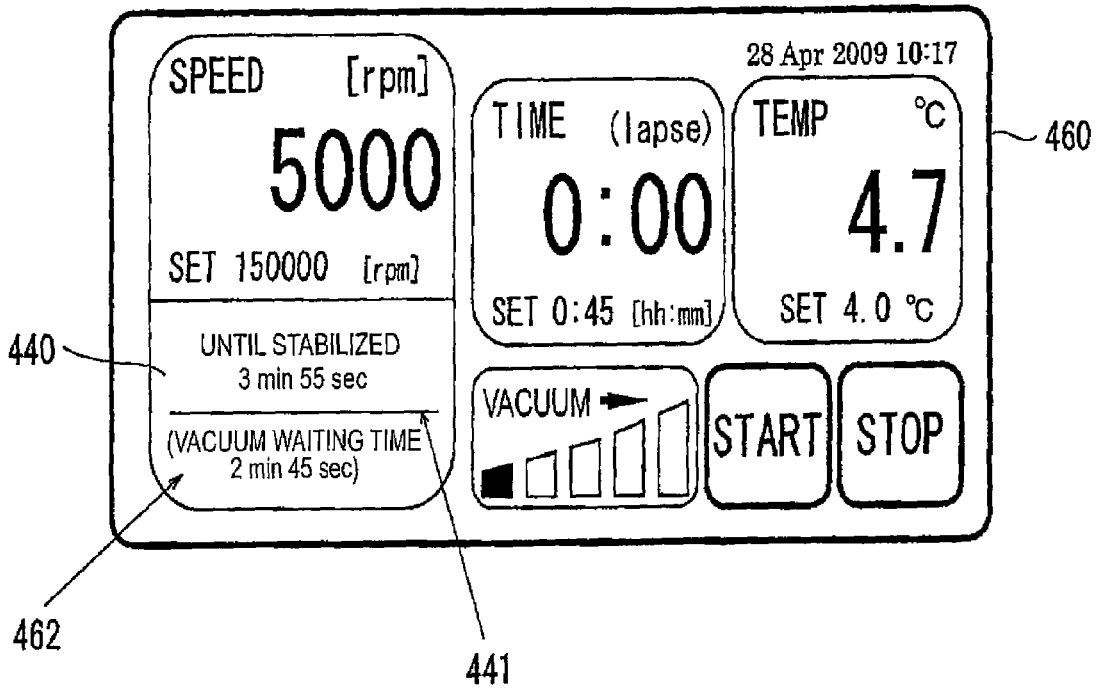
FIG. 15 is a diagram showing an example of a screen display according to a first modified example of the second embodiment.

In addition, the method of displaying the estimated stabilization arrival time on the operation/display unit 308 according to the second embodiment is not limited to the example shown in FIG. 8, but may be modified into various forms. FIG. 15 is a diagram showing the display screen according to a first modified example of the second embodiment. In a screen 460 shown in FIG. 15, a vacuum waiting time 462 is displayed instead of the estimated stabilization arrival time. In FIG. 15, the vacuum waiting time is displayed as "2 minutes and 45 seconds", which indicates that the vacuum waiting time (that is, an estimated time Tp) is 2 minutes and 45 seconds in the estimated stabilization arrival time 441 of "3 minutes and 55 seconds". Based on the fact, it is possible to recognize that more than a half of the stabilization arrival time is the vacuum waiting time and the time required for the acceleration of the rotor 303 is "3 minutes and 55 seconds−2 minutes and 45 seconds=1 minute and 10 seconds". Likewise, since the content of the estimated stabilization arrival time is displayed in detail, it is possible for the user to specifically recognize the current state of the centrifuge.

Figure 16:
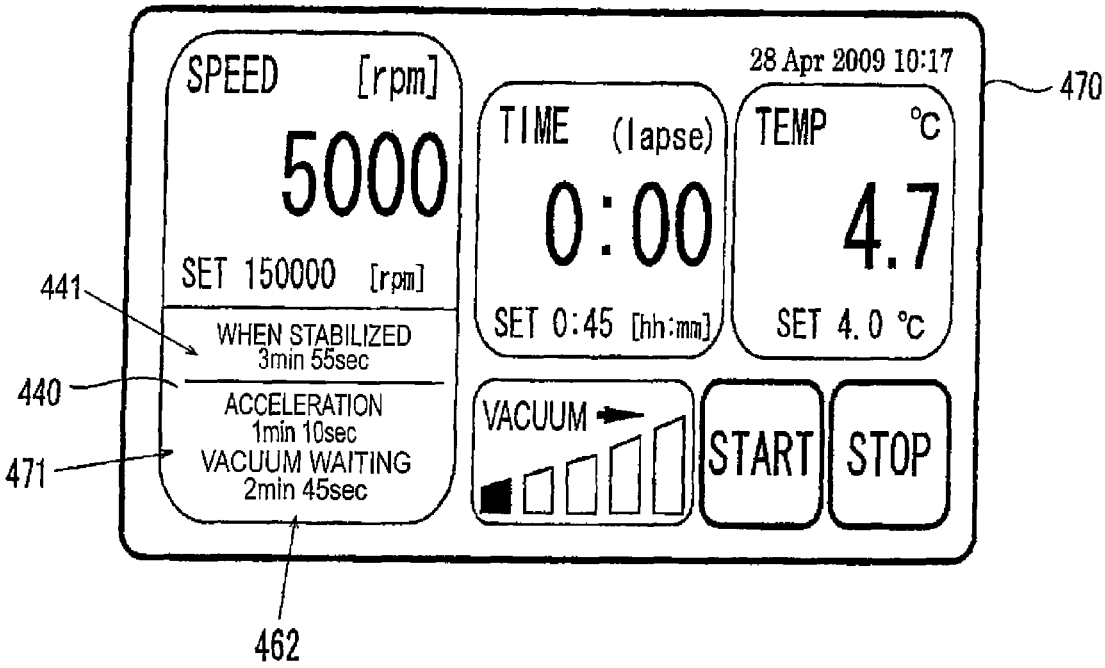
FIG. 16 is a diagram showing an example of a screen display according to a second modified example of the second embodiment.

FIG. 16 is a diagram showing an example of a screen display according to a second modified example of the second embodiment. In a screen 470 shown in FIG. 16, the estimated stabilization arrival time 441 shown in FIG. 15 is more specifically displayed, and an acceleration time 471 and the vacuum waiting time 462 are separately displayed. Likewise, since even the content in the estimated stabilization arrival time is specifically displayed, it is possible for the user to more specifically recognize the current state of the centrifuge.

Figure 17:
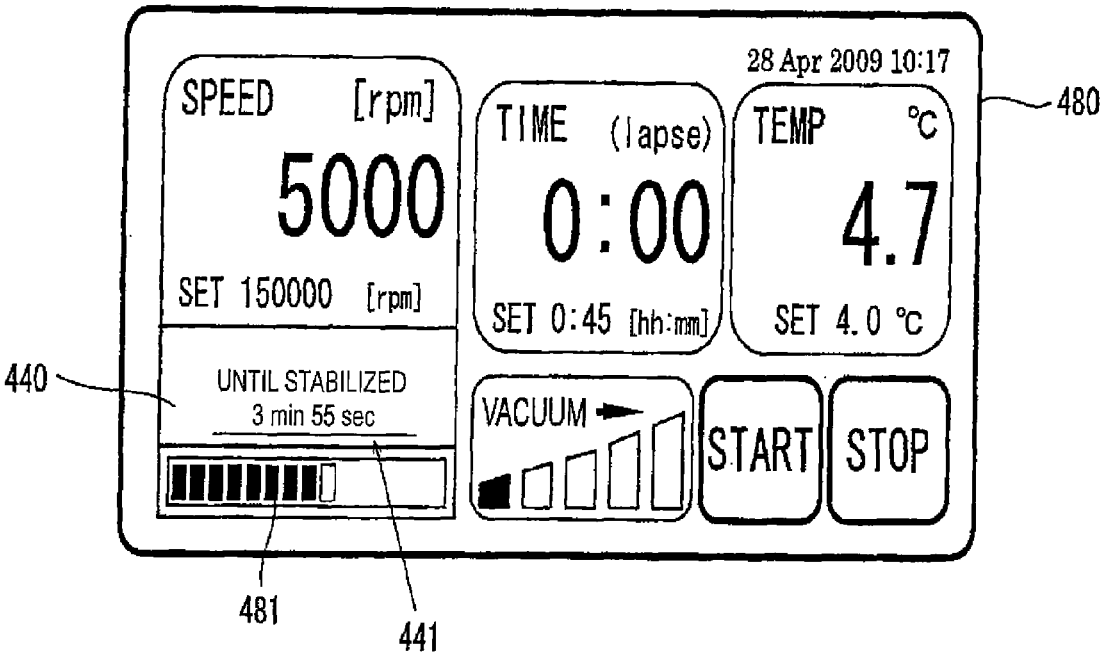
FIG. 17 is a diagram showing an example of a screen display according to a third modified example of the second embodiment.

FIG. 17 is a diagram showing an example of a screen display according to a third modified example of the second embodiment. In a screen 480 shown in FIG. 17, a process state is displayed as a bar display 481 below the estimated stabilization arrival time 441 shown in FIG. 15. Based on the bar display 481, it is possible to immediately perceive how much the current process state proceeds in the form of percentage in the estimated stabilization arrival time. In the example shown in FIG. 17, it is possible to perceive that the process state is about 60%. In addition, the leading bar display is depicted as a white rectangular mark instead of a black rectangular mark and the leading white bar is displayed in a flickering manner, which indicates that the process is performed as much as 8 bars or more and 9 bars or less.

While the exemplary embodiment of the invention is described as above, the invention is not limited thereto, but may be modified into various forms in the scope not departing from the spirit of the invention. For example, the entire time until the rotor stops after pushing the start button 130 and ending the centrifugal separation operation may be displayed instead of the stabilization arrival time 120 shown in FIG. 2, the stabilization time 121 shown in FIG. 3, the stop arrival time 122 shown in FIG. 4, and the stop time 123 shown in FIG. 5, or the entire time may be displayed together with them.

Further, in the invention, the method of calculating the estimated time until arriving at the vacuum or the method of estimating the time required for the acceleration of the rotor is not limited to the above-described embodiments, but an arbitrary method may be adopted. Furthermore, in the case where the estimated stabilization arrival time is influenced by other factors in addition to the acceleration time of the rotor and the time until the vacuum degree inside the vacuum chamber arrives at the predetermined degree, the estimated stabilization arrival time may be displayed in consideration of the factors.

Third Embodiment

Figure 18:
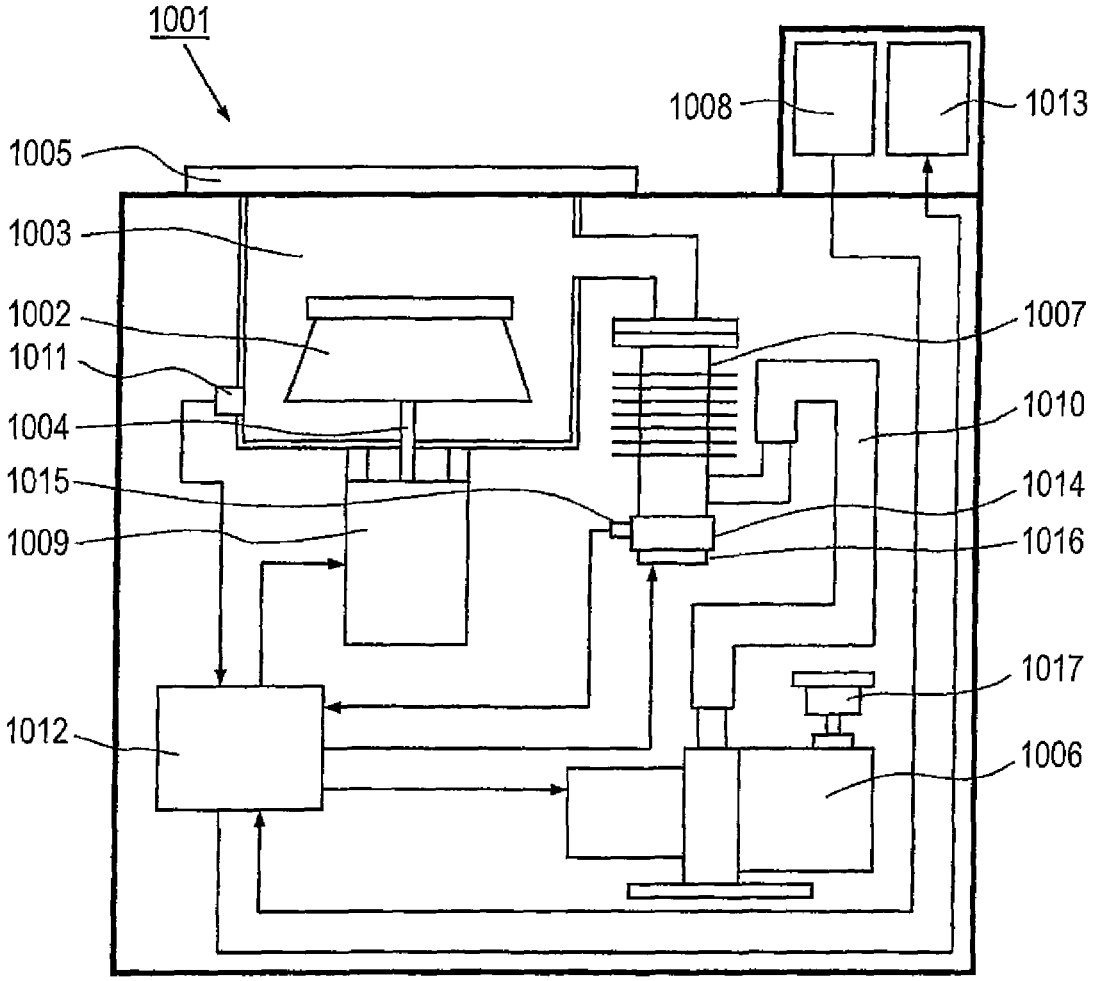
FIG. 18 is a sectional view showing a configuration of a centrifuge according to a third embodiment of the invention.

A centrifuge according to a third embodiment of the invention will be described with reference to FIG. 18. FIG. 18 is a sectional view showing a configuration of the centrifuge according to the embodiment. A centrifuge 1001 includes: a rotor 1002 which rotates while holding a sample; a rotation chamber 1003 which is a hermetic space used for accommodating the rotor 1002; a door 1005 through which the rotor 1002 is inserted into or extracted from the rotation chamber 1003; a vacuum pump (an oil rotation vacuum pump 1006 and an oil diffusion vacuum pump 1007) which depressurizes the rotation chamber 1003; an operation unit 1008 through which a user inputs a setting operation of a centrifugal separation condition; a display unit 1013 on which various information such as an operation state is displayed for the user; a driving device 1009 which rotates the rotor 1002; a vacuum sensor 1011 which measures a pressure inside the rotation chamber 1003; and a control unit 1012.

A perforation hole is formed in the lower portion of the rotation chamber 1003 so as to communicate the inside of the rotation chamber 1003 with the outside thereof, and a rotation shaft 1004 extending from the driving device 1009 passes through the perforation hole so that the rotor 1002 is attached to the front end of the rotation shaft 1004. In addition, the rotation shaft 1004 located in the perforation hole is sealed by a seal member (not shown) so as to maintain the hermetic state of the rotation chamber 1003. The rotor 1002 is provided with plural holes (not shown) into which tubes having samples are inserted. In this embodiment, the driving device 1009 can be rotated at a rotation speed of, for example, 40,000 rpm, and the samples are centrifugally separated by the centrifugal force generated by the rotation. In general, when the rotor 1002 rotates at a high speed under the atmospheric pressure, the rotor 1002 is heated by the air resistance. In addition, the high-speed rotation of the rotor 1002 is suppressed by the air resistance under the atmospheric pressure. Accordingly, it is necessary to suppress the air resistance in such a manner that the air inside the rotation chamber 1003 is extracted during the centrifugal separation operation so as to form a vacuum (depressurized) state.

The suction-side portion of the oil diffusion vacuum pump (DP) 1007 is connected to the rotation chamber 1003, and the discharge-side portion thereof is connected to a suction port of the oil rotation vacuum pump (VP) 1006 through a vacuum pipe 1010. The oil diffusion vacuum pump 1007 includes liquid oil therein, and is a general device which discharges the air inside the rotation chamber 1003 through the evaporating/condensing action inside the oil. Likewise, in this embodiment, as the vacuum pump, the oil diffusion vacuum pump 1007 is connected in serial to the oil rotation vacuum pump 1006. This is because one or two days are taken to obtain a predetermined vacuum degree (1 Pa or less) by using only the oil rotation vacuum pump 1006 and a predetermined back pressure (threshold back pressure: about 20 Pa) is required to operate the oil diffusion vacuum pump 1007. For this reason, it is necessary to provide an auxiliary pump for obtaining the threshold back pressure. The oil rotation vacuum pump 1006 serves as an auxiliary pump for the oil diffusion vacuum pump 1007. The discharge-side portion of the oil rotation vacuum pump 1006 is provided with an oil mist trap 1017 used for supplementing the oil mist contained in an exhaust gas.

The oil diffusion vacuum pump 1007 is provided with a DP boiler 1014 which accommodates operation oil therein and a DP heater 1016 which heats the operation oil. The temperature of the operation oil is measured by the temperature sensor 1015. The operation oil heated by the DP heater 1016 rises in the inside of a chimney (not shown) inside the oil diffusion vacuum pump, and is discharged as vapor from a nozzle disposed in the chimney and obliquely facing the DP boiler 1014. When gas molecules such as air collide with the vapor, the air is moved in a direction of the stream of the vapor, and flows to the discharge-side portion. Subsequently, the air inside the chamber connected to the oil diffusion vacuum pump is discharged to the outside, and the inside of the chamber becomes a vacuum state. The operation oil changed to the vapor is condensed and collected at a wall surface of the DP boiler 1014, and is heated again by the DP heater 1016.

The control unit 1012 includes a microcomputer, a volatile storage memory, and a nonvolatile storage memory which are not shown in the drawings, and generally controls the centrifuge 1001 in response to the output signals transmitted through the signal lines of the vacuum sensor 1011, the temperature sensor 1015, and the like, where the control unit performs the rotation control of the driving device 1009, the ON/OFF control of the oil rotation vacuum pump 1006, the ON/OFF control of the oil diffusion vacuum pump 1007, the information display on the display unit 1013, the input data acquisition from the operation unit 1008, and the like. The general control may be performed by software in such a manner that a program is executed by the microcomputer, but the invention is not limited thereto.

The display unit 1013 is a display device on which a variety of information is displayed for the user, and for example, a liquid crystal display device may be used as the display unit 1013. The operation unit 1008 is an input device through which required information is input from the user, and for example, a keyboard or a push button may be used as the operation unit 1008. In addition, when a touch-panel-type liquid crystal display device is used, the display unit 1013 and the operation unit 1008 can be formed as a single unit.

Figure 19:
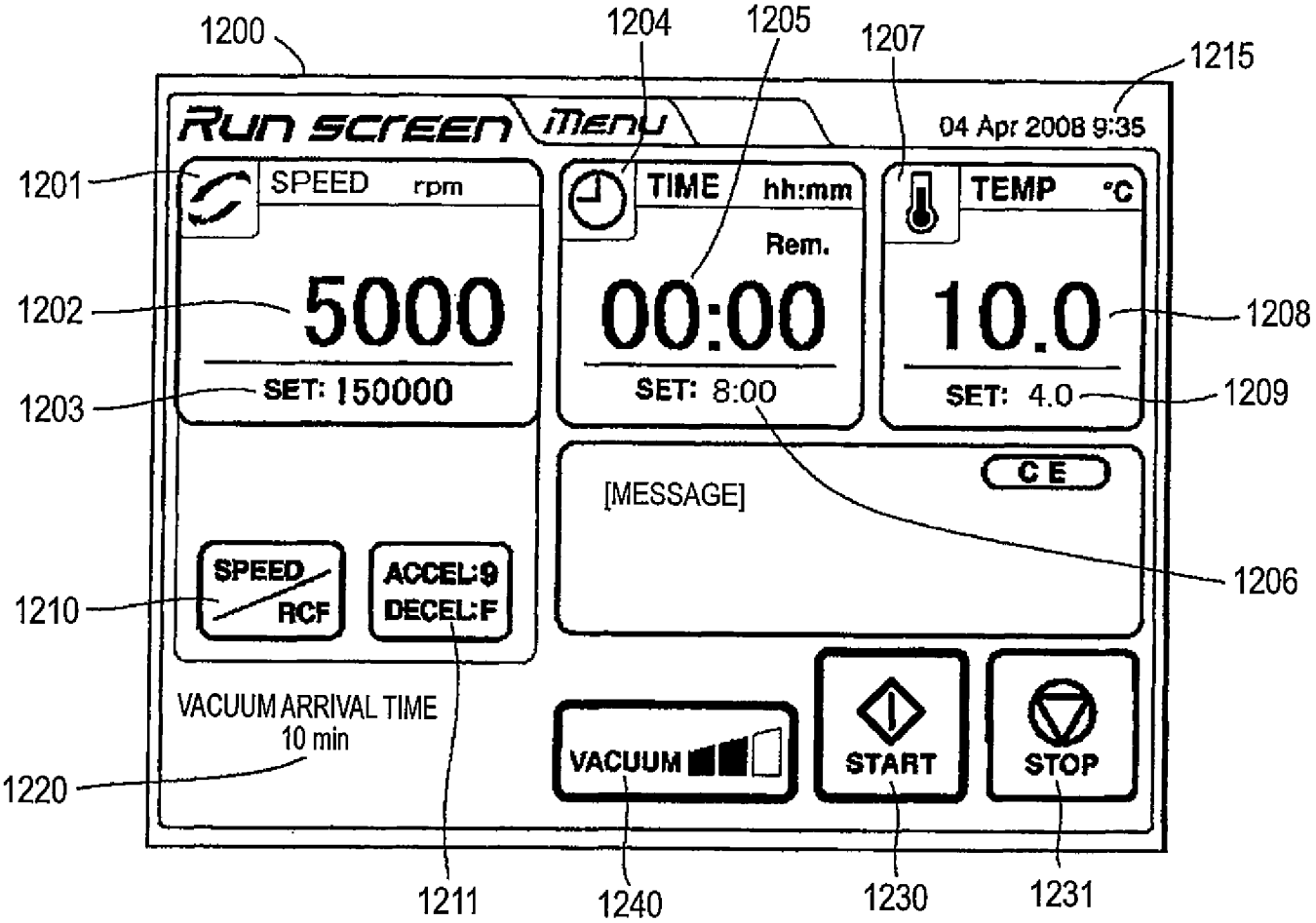
FIG. 19 is a diagram showing a display content in a display unit 1013 of the centrifuge shown in FIG. 18.

Next, an example of a screen of the touch-panel-type liquid crystal display device used as the display unit 1013 and the operation unit 1008 will be described with reference to FIG. 19. FIG. 19 shows a screen display in the state where the rotor 1002 is set to the driving shaft 1004, a start button 1230 is pushed to activate the vacuum pump, and "a vacuum waiting state" is maintained until the rotation chamber 1003 has a predetermined vacuum degree. In the vacuum waiting state, the rotor 1002 rotates at 5,000 rpm, and the rotor 1002 is controlled to have a set temperature. A display screen 1200 is mainly used to display an operation state and an operation condition (setting value) of the centrifuge 1001 thereon. The screen includes a rotation speed display region 1201, a time display region 1204, and a temperature display region 1207, where the rotation speed, the time, and the temperature are the operation conditions for the centrifuge. In the vicinity of the regions, there are shown a vacuum degree display 1240 which displays the current vacuum state using three bars, the start button 1230 which is used to command the start of the centrifugal separation operation, and a stop button 1231 which is used to command the stop of the rotation of the driving device 1009 or the stop of the centrifugal separation operation.

The large numeral "5,000" at the center of the rotation speed display region 1201 indicates a current rotation speed 1202 of the rotor 1002, and the lower stage (small characters) defined by the lower line portion indicates a set rotation speed 1203. When the user's finger touches a portion within the rotation speed display region 1201, a pop-up window of a numerical keyboard screen (not shown) is shown, and hence the user can set the rotation speed by operating the numerical keyboard screen.

The large numeral at the center of the time display region 1204 indicates an operation time (elapsed time) 1205 upon actually operating the rotor 1002 at the set rotation speed 1203, and is displayed by the unit of hours/minutes. The operation time 1205 is automatically counted and displayed by using a timer function included in the microcomputer of the control unit 1012. The lower stage (small characters) defined by the lower line portion indicates a set operation time 1206 for performing the centrifugal separation operation. The large characters at the center of the temperature display region 1207 indicates a current rotor temperature 1208 inside the rotation chamber 1003, and the lower end (small characters) of the lower line portion indicates a set temperature 1209 of the rotor 1002 which needs to be maintained during the centrifugal separation operation.

A SPEED/RCF button 1210 is a display changing button for determining whether the rotation speed (SPEED) of the rotor 1002 or the centrifugal acceleration (RCF) is displayed in the rotation speed display region. Whenever the SPEED/RCF button 1210 is touched, the display in the rotation speed display region 1201 is changed from the rotation speed to the centrifugal acceleration, or is changed from the centrifugal acceleration to the rotation speed. An ACCEL/DECEL button 1211 is a button for changing a setting state of an acceleration mode or a deceleration mode. The acceleration time of 0 to 5,000 rpm may be selected from plural options in the acceleration mode, the deceleration time of 5,000 to 0 rpm may be selected from plural options in the deceleration mode, or the natural deceleration is performed from the set rotation speed. A current date 1215 is displayed on the right upper portion of the screen 1200.

Figure 20:
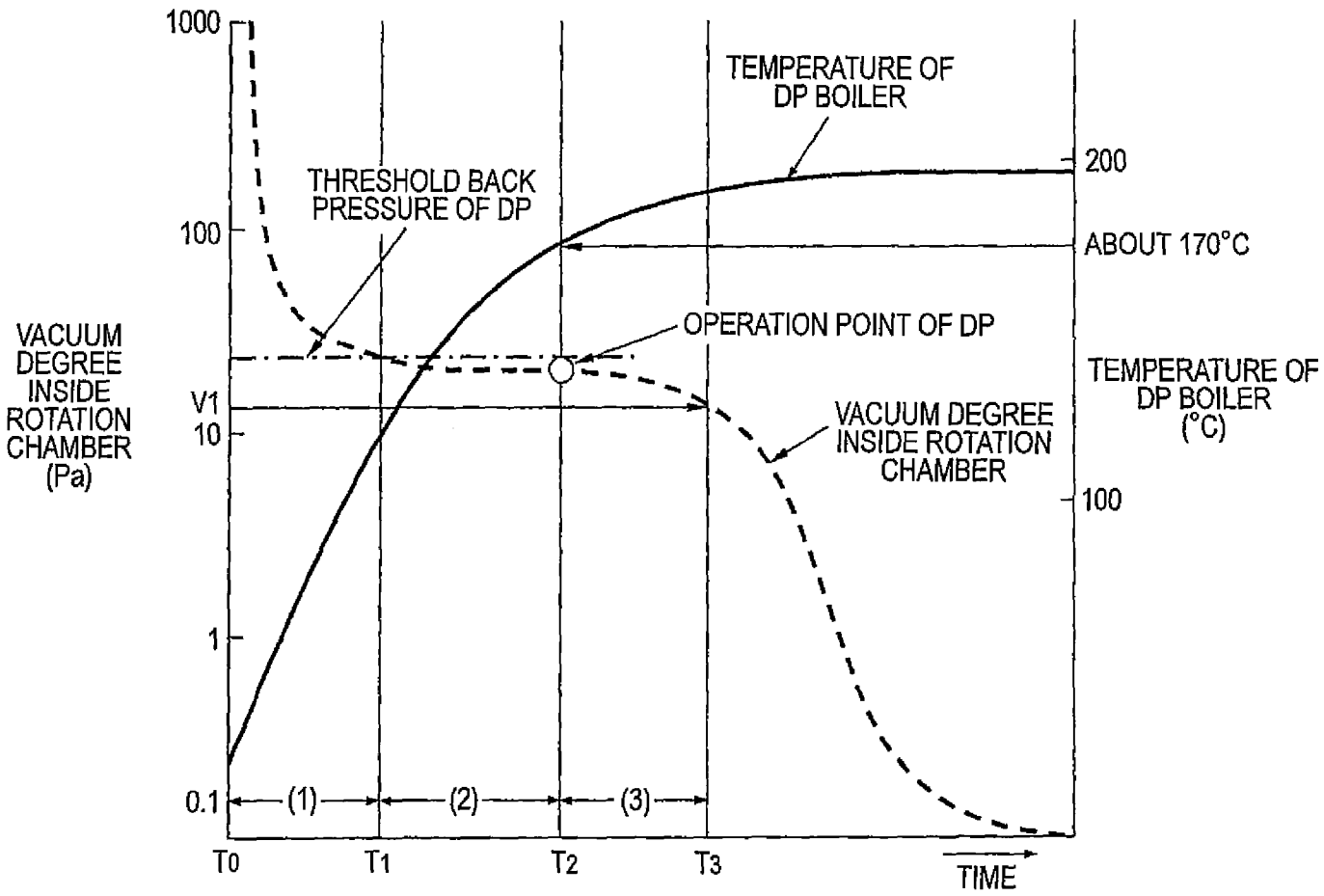
FIG. 20 is a diagram showing a relationship of a temperature of a DP boiler, a vacuum degree of a rotation chamber, and an elapsed time upon depressurizing a rotation chamber 1003 by using a vacuum pump of the centrifuge shown in FIG. 18.

A vacuum degree display 1240 is used to simply display the vacuum degree inside the rotation chamber 1003 by using three bars. For example, one bar is displayed until a middle vacuum degree is obtained after turning on the vacuum pump, two bars are displayed when the middle vacuum degree (for example, 133 Pa) is obtained, and three bars are displayed when a high vacuum degree (for example, 13.3 Pa) is obtained. In FIG. 19, two bars are displayed. A vacuum arrival time 1220 is a main displayed content, and displays a time to be taken from the current state until the vacuum degree of the rotation chamber 1003 arrives at a predetermined vacuum degree $V_1$. In FIG. 20, the time taken for the predetermined vacuum degree $V_1$ is 10 minutes.

Next, a relationship between the vacuum degree inside the rotation chamber and the elapsed time upon depressurizing the rotation chamber 1003 by using the vacuum pump will be described with reference to FIG. 20. The relationship is closely related to the calculation of "the vacuum arrival time". In FIG. 20, the left vertical axis indicates the vacuum degree (unit: Pa) of the rotation chamber 1003, and the horizontal axis indicates the elapsed time (unit: sec). In addition, the right vertical axis indicates the boiler temperature (unit: ° C.) of the oil diffusion vacuum pump (DP) 1007.

When the operation of two vacuum pumps starts at the time point $T_0$, the vacuum degree inside the rotation chamber (the curve depicted by the dotted line in FIG. 20) gradually decreases from the atmospheric pressure. Meanwhile, since the DP heater 1016 of the oil diffusion vacuum pump 1007 is turned on, the temperature of the DP boiler increases with time. The curve depicted by the solid line in FIG. 20 shows the increase state. There are two conditions for starting the oil diffusion vacuum pump 1007. One of them is that the vacuum degree is not more than the required back pressure (threshold back pressure), and the other is that the temperature of the DP boiler arrives at a predetermined temperature value, that is, the boiling temperature of the internal oil. In the graph shown in FIG. 19, the time region (1) indicates a time required until the vacuum degree inside the rotation chamber arrives at the threshold back pressure, required for the operation of the oil diffusion vacuum pump 1007, by the action of the oil rotation vacuum pump 1006. Herein, at the time point $T_1$, the vacuum degree inside the rotation chamber arrives at the threshold back pressure of the oil diffusion vacuum pump 1007.

In the time region (2) after the time point $T_1$, one condition for starting the operation of the oil diffusion vacuum pump 1007 is satisfied. However, the temperature of the DP boiler is not sufficiently increased yet, and is not increased up to the operation point. In other words, the time region (2) is a region before the start of the operation of the oil diffusion vacuum pump 1007. Even in the time region (2), the vacuum degree inside the rotation chamber continuously decreases by the action of the oil rotation vacuum pump 1006, but the decrease ratio of the vacuum degree inside the rotation chamber is small due to the relationship of the efficiency in the vicinity of the vacuum degree of the oil rotation vacuum pump 1006.

The time required in the time region (2), that is, the time from the time point $T_1$ to the time point $T_2$ is largely dependent on the temperature of the DP boiler at the time point $T_0$ when the depressurizing operation starts. For example, as in the case where the centrifuge 1001 is operated at the first time in the day, when the temperature of the DP boiler is decreased down to about a room temperature, the time required in the time region (2) becomes long. On the contrary, as in the case where the centrifugal separation operation is continuously performed, when the temperature of the DP boiler is sufficiently high due to the precedent centrifugal separation operation, the time required in the time region (2) becomes short or zero.

Since the second condition for starting the operation of the oil diffusion vacuum pump 1007 is satisfied, that is, "the temperature of the DP boiler arrives at about 170° C." at the time point $T_2$, the oil diffusion vacuum pump 1007 starts to be operated. Accordingly, the vacuum degree inside the rotation chamber largely decreases, and arrives at a desired vacuum degree ($V_1$) at the time point $T_3$. The vacuum degree $V_1$ is a vacuum degree at which the rotor 1002 can be continuously rotated without an increase in the temperature due to friction with the remaining air in the case where the rotor 1002 is rotated at a high speed. In addition, it is ideal that the high-speed rotation of the rotor 1002 is performed after arriving at the vacuum degree $V_1$ (about 13.3 Pa). However, due to the relationship of the reduction of the centrifugal separation time and the time (comparatively short time) required in the time region (3), the rotor 1002 may be rotated after accelerating up to the rpm of the set speed when moving to the time region (3). In this case, in the time regions (1) and (2), the rotor 1002 is not rotated or is rotated at a very slow speed (for example, about 5,000 rpm).

Figure 21:
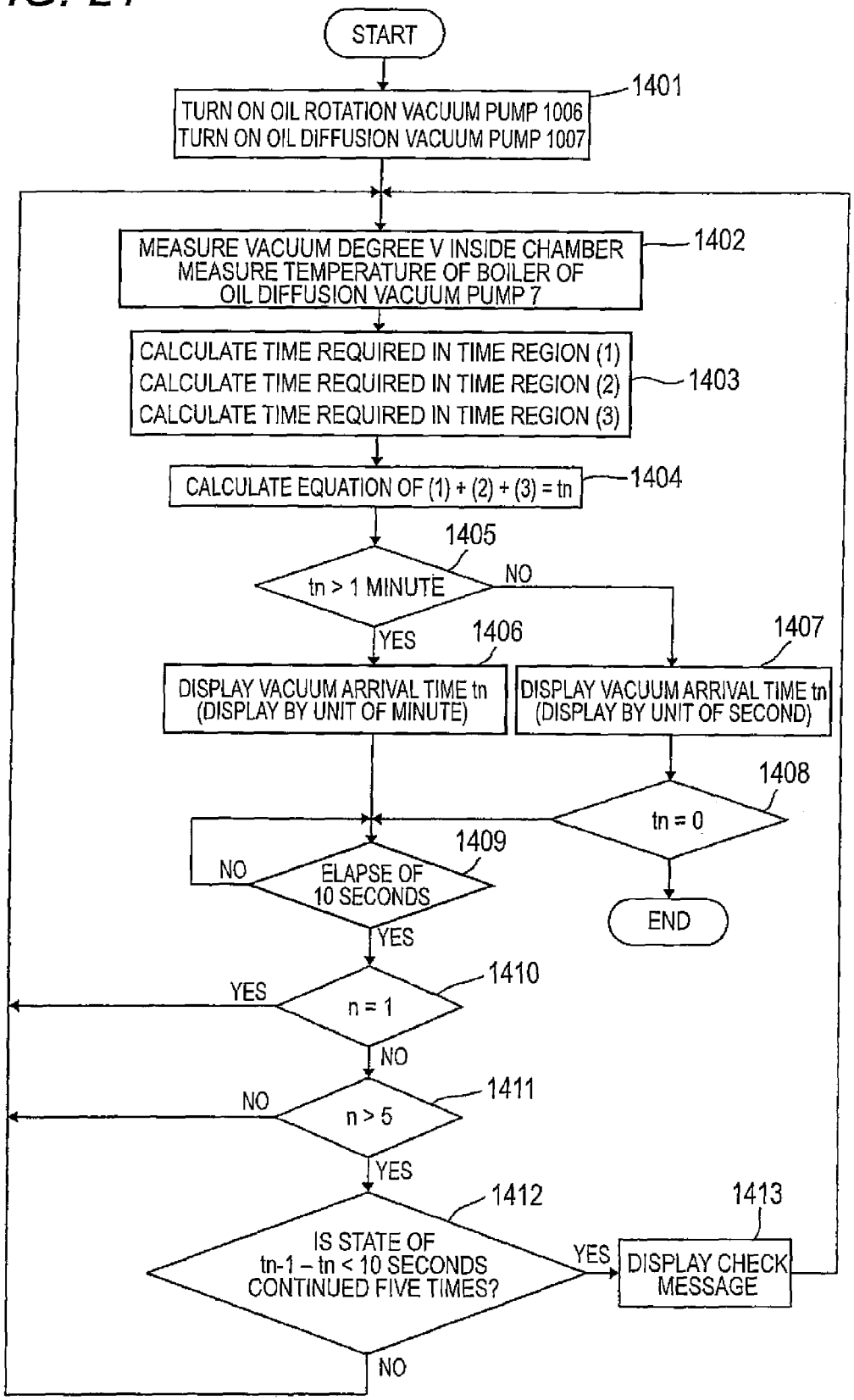
FIG. 21 is a flowchart showing a sequence of operating the centrifuge shown in FIG. 1.

Next, a sequence of displaying an estimated vacuum arrival time will be described with reference to the flowchart shown in FIG. 21. A series of operations shown in FIG. 21 can be performed by the program stored in advance in the control unit 1012 in the manner of the software support. First, the user sets the rotor 1002, to which the tubes having samples are set, to the inside of the rotation chamber 1003, and closes the door 1005. Subsequently, the user inputs the operation conditions such as the set rotation speed and the set operation time through the operation unit 1008. When the control unit 1012 receives the required input information and detects that the start button 1230 (FIG. 19) is pushed, the control unit 1012 turns on the oil rotation vacuum pump 1006 and the oil diffusion vacuum pump 1007 so as to start the depressurizing operation (Step 1401).

Subsequently, the control unit 1012 measures the vacuum degree V inside the rotation chamber 1003 by using the output of the vacuum sensor 1011, and measures the temperature T of the DP boiler 1014 of the oil diffusion vacuum pump 1007 by using the output of the temperature sensor 1015 (Step 1402). Subsequently, at this time point, the estimation time in each of the time regions (1), (2), and (3) shown in FIG. 20 is calculated based on the measured data (Step 1403). Before this estimation, the exhaust characteristic data of the vacuum system determined by the capacity of the rotation chamber, the path of the exhaust pipe, and the exhaust characteristic of the vacuum pump is stored in advance in storage means (not shown) of the control unit 1012. Based on the data, the time taken for the predetermined vacuum degree $V_1$ is estimated, and the resultant is displayed on the display unit 1013.

Regarding the time region (1) shown in FIG. 20, the control unit 1012 estimates the time until the vacuum degree of the rotation chamber 1003 arrives at the threshold back pressure of the oil diffusion vacuum pump 1007 based on the exhaust characteristic data of the oil rotation vacuum pump 1006. Since the exhaust characteristic data is expressed as a curve substantially unambiguously determined by the oil rotation vacuum pump 1006, the data of one curve may be stored in the control unit 1012. In addition, for the more precise estimation, plural curves may be prepared in consideration of various parameters such as the precedent depressurizing operation, the room temperature, and the atmospheric temperature, and may be stored in the control unit 1012 so as to determine the corresponding curve upon starting the depressurizing operation.

Regarding the time region (2) shown in FIG. 20, the control unit 1012 stores the temperature increase curve of the operation oil of the oil diffusion vacuum pump 1007. The inclination of the temperature increase curve is substantially unambiguously determined by the characteristics of the DP boiler 1014 and the DP heater 1016. When the temperature increase curve is compared with the temperature (initial temperature) of the operation oil at the time point $T_0$ shown in FIG. 20, it is possible to easily estimate the time required between the time points $T_1$ and $T_2$. However, the inclination of the temperature increase curve may be slightly changed in accordance with the room temperature. For this reason, for the more precise estimation, the temperature increase curve for each room temperature may be stored in the control unit 1012 so as to perform the estimation by using the stored temperature increase curves.

Regarding the time region (3) shown in FIG. 20, the control unit 1012 stores the data from the threshold back pressure to the predetermined vacuum degree $V_1$. The time required in the region from the threshold back pressure to the predetermined vacuum degree $V_1$ is substantially uniform, and is substantially unambiguously determined by the performance of the oil diffusion vacuum pump. Accordingly, when the value of the vacuum degree inside the rotation chamber is provided at the time point $T_2$ of the time region (3), it is possible to estimate the time point $T_3$ at which the predetermined vacuum degree $V_1$ is obtained.

Subsequently, a sum $t_n$ of the estimation time measured for each of the regions is calculated (Step 1404). Since the operations in Step 1402 to 1404 to be described later are periodically repeated until the vacuum degree inside the rotation chamber 1003 arrives at the predetermined vacuum degree $V_1$, the estimation time of the time region (1) is 0 in the state of the time region (2), and the estimation time of the time regions (1) and (2) is 0 in the state of the time region (3). Subsequently, in the case where the sum $t_n$ of the estimation time is within 1 minute (Step 1405), the proceeding arrival time (a remaining time until the vacuum arrival time) $t_n$ is displayed on the display unit 1013 by the unit of second. In the case where the sum $t_n$ is more than 1 minute (Step 1405) the proceeding arrival time $t_n$ is displayed on the display unit 1013 by the unit of minute (Step 1406).

In the case where the sum $t_n$ of the estimation time is equal to 0, the display operation of the vacuum arrival time 1220 ends, and the current display value is changed to a predetermined time "0". In the case where the sum $t_n$ of the estimation time is not equal to 0, the current step moves to Step 1409 (Step 1408). In Step 1409, a waiting time of ten seconds is created, and the current step moves to Step 1410 after ten seconds. In Step 1410, it is determined whether n is equal to 1, and the current step returns to Step 1402 in the case of 1. Here, n indicates the count value of the number of times of the calculation in Step 1404, and n increases in an order of 1, 2 . . . so as to have an increment of "1" whenever performing the operation in Step 1404. Accordingly, the state of n=1 indicates the first calculation of the estimated vacuum arrival time.

In Step 1409, it is determined whether n is larger than 5, and the current step moves to Step 1402 in the case where the condition of n>5 is not satisfied (Step 1411). Subsequently, it is determined whether the state of $t_{n-1}-t_n<10$ seconds is continued five times, and the current step returns to Step 1402 in the case where the state is not continued (Step 1412). On the other hand, in the case where the state is continued, a check message for prompting the user to check the operation of the vacuum pump is displayed, and the current step moves to Step 1402 (Step 1413). Various contents of the check message may be considered. For example, the sentence of "Is there any condensation inside the rotation chamber?" may be displayed. In addition, in the case where the compared vacuum arrival time is not reduced over a predetermined number of times or more, it is determined that the centrifuge is abnormal, and the control unit 1012 performs a required error process (the operation of stopping the rotation of the rotor 1003).

As described above, in this embodiment, since the time until the predetermined vacuum state is realized after pushing the start button of the centrifuge is displayed on the display unit 1013, the user can recognize the waiting time. Accordingly, the user does not have to tediously wait as in the case without the waiting time or does not have to uselessly spend a time.

While the exemplary embodiment of the invention is described as above, the invention is not limited thereto, but may be modified into various forms in the scope not departing from the spirit of the invention. For example, a humidity sensor may be provided so as to measure the humidity inside the rotation chamber, and the control unit may estimate the vacuum arrival time in consideration of the value of the humidity sensor. In this case, plural vacuum arrival curves showing the humidity may be stored in the control unit.

This application claims priority from Japanese Patent Application No. 2009-202108 filed on Sep. 1, 2009, Japanese Patent Application No. 2008-284861 filed on Nov. 5, 2008, and Japanese Patent Application No. 2008-281250 filed on Oct. 31, 2008, the entire contents of which are incorporated herein by reference.

INDUSTRIAL APPLICABILITY

An aspect of the present invention relates to a centrifuge capable of rotating a rotor having a sample set thereto at a high speed, and particularly, to a centrifuge capable of allowing a user to easily recognize a time required for accelerating or decelerating an activated rotor.

Another aspect of the present invention relates to a centrifuge which depressurizes a rotation chamber, and particularly, to a centrifuge having a function of estimating a vacuum arrival time until arriving at a predetermined vacuum degree and displaying the vacuum arrival time on a display unit.

The invention claimed is:

1. A centrifuge comprising:

a driving unit which rotates a rotor on which a sample is held;

an input/output unit which receives input information indicative of a set rotation speed of the rotor and a set operation time period for performing a centrifugal operation from a user therethrough;

a control unit which controls a rotation speed of the rotor based on the received input information and that includes a controller configured to calculate a first time information indicative of an amount of the set operation time period remaining until the rotor speed of the rotor arrives at the set rotation speed based at least upon (i) rotor information which is associated with the centrifuge, (ii) input set rotation speed and (iii) rotation acceleration inclination pattern; and a display unit configured to display the information of the set rotation speed of the rotor and the set operation time period for performing the centrifugal operation, and further, when the rotor is rotated, to display the first time information indicative of the amount of the set operation time period remaining until the rotor speed of the rotor arrives at the set rotation speed, wherein the control unit stores a plurality of rotation acceleration inclination patterns of the rotor, and wherein the control unit calculates the first time information from a corresponding one of the rotation acceleration inclination patterns that is selected from the stored rotation acceleration inclination patterns based on an actual rotation acceleration inclination of the rotor rotated by the driving unit.

2. The centrifuge according to claim 1, wherein the control unit stores in advance an acceleration time taken for each type of the rotor, and wherein the control unit calculates the first time information by identifying the rotor attached to the driving unit and reading the acceleration time taken for the identified rotor.

3. The centrifuge according to claim 1, wherein the input/output unit includes a change button enabling selective visualization on the display unit, when the rotor is rotated, of the time information indicating the amount of time remaining until the rotor speed of the rotor arrives at the set rotation speed or time information indicating a time when the rotation speed of the rotor will arrive at the set rotation speed.

4. The centrifuge according to claim 1, wherein, when the rotor is decelerated, the input/output unit displays second time information corresponding to a time when the rotor stops.

5. The centrifuge according to claim 4, wherein the second time information is an amount of time remaining until the rotation of the rotor stops.

6. The centrifuge according to claim 4, wherein the second time information is indicative of a time when the rotation of the rotor will stop.

7. The centrifuge according to claim 1, further comprising:

a depressurization unit which depressurizes a rotor chamber accommodating the rotor, and wherein the display unit is further configured to display, when the rotor is rotated, the time information corresponding to the time when the rotor has been accelerated to the set rotation speed.

8. The centrifuge according to claim 7, wherein the time information is calculated based on a time to be taken until the rotor chamber has been completely depressurized and a time to be taken until the rotor has been accelerated to the set rotation speed after being depressurized.

9. The centrifuge according to claim 8, wherein, when a pressure of the rotor chamber is larger than a predetermined value, the controller unit controls the rotor to rotate at a limited rpm, and wherein, when the pressure of the rotor chamber is not more than the predetermined value, the controller unit controls the rotor to accelerate from the limited rpm to the set rotation speed.

10. The centrifuge according to claim 9, wherein the time information is an amount of time remaining until the rotation speed of the rotor arrives at the set rotation speed.

11. The centrifuge according to claim 9, wherein the time information is indicative of a time when the rotation speed of the rotor will arrive at the set rotation speed.

12. The centrifuge according to claim 9, wherein the time information is recalculated and displayed on the display unit per predetermined time.

13. The centrifuge according to claim 1 further comprising:

a vacuum pump which depressurizes a pressure of a rotation chamber by sucking air therefrom;

wherein the control unit calculates a vacuum arrival time to be taken until a predetermined vacuum degree has been obtained by the vacuum pump, and the display unit displays the calculated vacuum arrival time.

14. The centrifuge according to claim 13, wherein the predetermined vacuum degree is a vacuum degree at which the rotor can continuously rotate at an user-set rpm without increasing the temperature due to friction with remaining air.

15. The centrifuge according to claim 13, wherein the control unit recalculates the vacuum arrival time at a predetermined interval, and the display unit displays the recalculated vacuum arrival time.

16. The centrifuge according to claim 13, wherein the vacuum pump includes an oil diffusion vacuum pump, wherein the oil diffusion vacuum pump includes a temperature sensor which detects a temperature of an operation oil, and wherein the control unit calculates the vacuum arrival time based on the temperature of the operation oil detected by the temperature sensor.

17. The centrifuge according to claim 16, wherein the vacuum pump further includes an oil rotation vacuum pump, and wherein a depressurizing operation is performed by the oil rotation vacuum pump until arriving at a threshold back pressure, at which the oil diffusion vacuum pump effectively operates, from an atmospheric pressure.

18. The centrifuge according to claim 17, wherein the control unit calculates the vacuum arrival time in such a manner that three divided time regions are obtained, an estimated arrival time for each of the time regions is calculated, and a sum of the estimated arrival time is obtained, where the three divided time regions include a time region (1) from a depressurization start to the threshold back pressure of the oil diffusion vacuum pump, a time region (2) from the threshold back pressure until the temperature of the operation oil arrives at an operation temperature of the oil diffusion vacuum pump, and a time region (3) until the oil diffusion vacuum pump effectively operates and the predetermined vacuum degree is obtained.

19. The centrifuge according to claim 18, wherein the control unit stores in advance a temperature curve of the oil diffusion vacuum pump or an arrival curve of the vacuum degree inside the rotation chamber for each of the time regions (1) to (3), and calculates the estimated arrival time for each of the time regions by using the stored curves.

20. The centrifuge according to claim 13, wherein the control unit compares the vacuum arrival time recalculated at a predetermined interval, and displays a message on the display unit when a change of the compared vacuum arrival time is abnormal.

21. The centrifuge according to claim 20, wherein the control unit determines that the abnormality occurs when the state where the compared vacuum arrival time is not reduced is continued over a predetermined number of times or more.

* * * * *